US012520912B2

(12) United States Patent
Kim et al.

(10) Patent No.: US 12,520,912 B2
(45) Date of Patent: Jan. 13, 2026

(54) WATCHBANDS WITH BUCKLES AND WOVEN FABRICS

(71) Applicant: Apple Inc., Cupertino, CA (US)

(72) Inventors: Seul Bi Kim, San Mateo, CA (US); Camille I. Henrot, San Francisco, CA (US); Clement C. Tissandier, San Francisco, CA (US); Donald L. Olmstead, Aptos, CA (US); Jessica J. Lu, Menlo Park, CA (US); Kristen L. Cretella, San Francisco, CA (US); Molly J. Anderson, San Francisco, CA (US); Tirshathah A. Hunter, San Leandro, CA (US); Yoji Hamada, Wakayama (JP)

(73) Assignee: Apple Inc., Cupertino, CA (US)

( * ) Notice: Subject to any disclaimer, the term of this patent is extended or adjusted under 35 U.S.C. 154(b) by 228 days.

(21) Appl. No.: 18/134,476

(22) Filed: Apr. 13, 2023

(65) Prior Publication Data

US 2024/0074551 A1 Mar. 7, 2024

Related U.S. Application Data

(60) Provisional application No. 63/404,115, filed on Sep. 6, 2022.

(51) Int. Cl.
*A44C 5/00* (2006.01)
*A44C 5/20* (2006.01)

(52) U.S. Cl.
CPC ..... *A44C 5/2019* (2013.01); *A44C 5/0053* (2013.01)

(58) Field of Classification Search
CPC ..... A44C 5/0053; A44C 5/2019
USPC ..... 224/267
See application file for complete search history.

(56) References Cited

U.S. PATENT DOCUMENTS

| | | | | |
|---|---|---|---|---|
| 4,213,548 | A * | 7/1980 | Wood | A44C 5/0053 968/359 |
| 5,860,706 | A * | 1/1999 | Fausel | B60R 22/22 280/801.1 |
| 5,997,039 | A * | 12/1999 | Manninen | A63C 11/2228 2/160 |
| 6,715,186 | B1 * | 4/2004 | Huang | A41F 15/005 24/3.13 |
| D666,942 | S * | 9/2012 | Iannello | D11/210 |
| 9,380,838 | B2 * | 7/2016 | Iannello | A45F 5/02 |
| 9,955,761 | B2 * | 5/2018 | Maddox | A45F 5/00 |
| 10,299,576 | B2 * | 5/2019 | Rose | A63C 11/025 |
| D903,527 | S * | 12/2020 | Spater | D11/218 |
| D907,528 | S * | 1/2021 | Paik | D11/218 |
| D920,159 | S * | 5/2021 | Power, II | D11/218 |
| 11,129,434 | B2 * | 9/2021 | Opalacz | A43C 11/14 |

(Continued)

*Primary Examiner* — Peter N Helvey
(74) *Attorney, Agent, or Firm* — BAKERHOSTETLER

(57) ABSTRACT

A watchband can comfortably secure an electronic device to a wrist of a user. The watchband can include a base having a contact surface opposite an engagement surface and an engagement ribbon forming loops on the engagement surface of the base for receiving a hook of a buckle. The engagement ribbon can be interwoven with the base to provide secure anchoring for the hook within one of the loops. The woven portions of the watchband can be securely coupled to end structures, such as the buckle, retaining rings, and/or a connector. The watchband provides adjustable lengths to accommodate different fit configurations as desired.

20 Claims, 23 Drawing Sheets

(56) References Cited

U.S. PATENT DOCUMENTS

| | | | | |
|---|---|---|---|---|
| 11,199,376 | B2 * | 12/2021 | Marshall | F41C 33/002 |
| D1,052,849 | S * | 12/2024 | Morgan | A41F 3/04 D2/640 |
| 2008/0155792 | A1 * | 7/2008 | Yeh | A44B 11/04 24/169 |
| 2009/0127308 | A1 * | 5/2009 | Mori | A45C 11/00 29/428 |
| 2014/0338157 | A1 * | 11/2014 | Iannello | A44B 11/04 24/318 |
| 2015/0150363 | A1 * | 6/2015 | Cavolt | A45F 5/021 224/666 |
| 2015/0208768 | A1 * | 7/2015 | Iannello | A44B 11/2592 24/163 R |
| 2016/0010673 | A1 | 1/2016 | Russell-Clarke et al. | |
| 2016/0081446 | A1 * | 3/2016 | Maddox | A45F 3/14 224/257 |
| 2017/0280831 | A1 * | 10/2017 | Ritchie | E05B 67/383 |
| 2019/0029373 | A1 | 1/2019 | Shaffer et al. | |
| 2019/0320755 | A1 * | 10/2019 | Opalacz | A43B 3/126 |
| 2023/0210218 | A1 * | 7/2023 | Pence | A43C 1/006 36/11 |
| 2025/0041648 | A1 * | 2/2025 | Renaud | A63B 21/065 |

* cited by examiner

WATCHBANDS WITH BUCKLES AND WOVEN FABRICS

CROSS REFERENCE TO RELATED APPLICATIONS

This application claims the benefit of priority to U.S. Provisional Patent Application No. 63/404,115, entitled, "Watchbands with Buckles and Woven Fabrics", filed on Sep. 6, 2022, the disclosure of which is hereby incorporated herein in its entirety.

TECHNICAL FIELD

The present description relates generally to securement of wearable devices, and, more particularly, to watchbands with buckles and woven fabrics.

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin, and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device can depend on the function and arrangement of the watchband.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
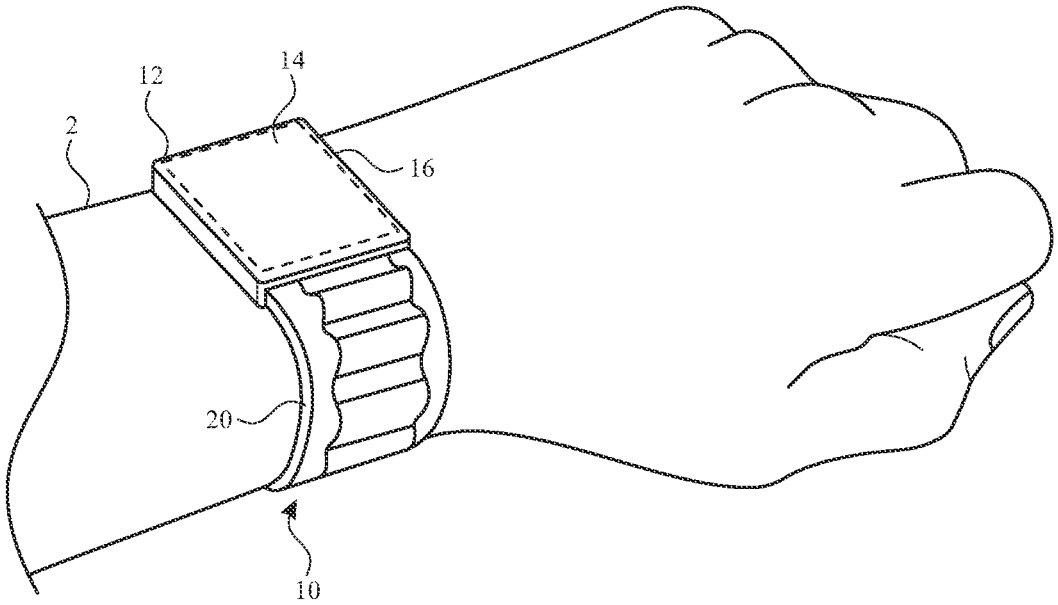
FIG. 1 is a perspective view of a watch on a wrist of a user, in accordance with some embodiments of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form to avoid obscuring the concepts of the subject technology.

An electronic device, such as a wristwatch or fitness/health tracking device, can be attached to a user's wrist by a watchband. It can be desirable to maintain a secure attachment to the wrist so that the electronic device does not shift excessively or slip off the user. Securement of the electronic device against the user can also be important to the function of electronic components, such as biometric sensors. Additionally, it can be desirable to maximize the comfort of the user while wearing the electronic device. Often, a secure attachment can apply an undesirable amount of force on the wrist of the user. In many cases, conventional watchbands may catch, pinch, or pull a user's hair or skin during use if the band is overly tight. In other cases, watchbands may slide along a user's wrist, turn about a user's wrist, or may be otherwise uncomfortable or bothersome to a user if the band is overly loose. These problems can be exacerbated during periods of heightened activity, such as while running or playing sports.

Furthermore, adjusting the size or fit of conventional watchbands often requires multiple steps, specialized tools, and/or technical expertise. Sizing options available to a user may be insufficient to obtain a proper fit. The fit may be different and/or may be perceived to be different given certain environmental (e.g., temperature, humidity) or biological conditions (e.g., sweat, inflammation). As a result, users of conventional wristwatches and/or fitness/health tracking devices may select a tolerable (although not optimally comfortable) fit, reserving tight bands for fitness/health tracking devices and loose bands for conventional wristwatches. However, some wearable electronic devices may be multi-purpose devices, providing both fitness/health tracking and timekeeping functionality. Accordingly, a user may prefer the fit of a watch to vary with use. For example, a user may prefer a looser fit in a timekeeping mode and a tighter fit in a fitness/health tracking mode. Accordingly, there may be a present need for systems and methods for dynamic adjustment of the fit of wearable electronic devices.

Embodiments of the present disclosure provide hook and loop attachment mechanisms. Accordingly, embodiments of the present disclosure provide a watchband that can comfortably secure an electronic device to a wrist of a user. The watchband can include a base having a contact surface opposite an engagement surface and an engagement ribbon forming loops on the engagement surface of the base for receiving a hook of a buckle. The engagement ribbon can be interwoven with the base to provide secure anchoring for the hook within one of the loops. The woven portions of the watchband can be securely coupled to end structures, such as the buckle, retaining rings, and/or a connector. The watchband provides adjustable lengths to accommodate different fit configurations as desired.

These and other embodiments are discussed below with reference to FIGS. 1-67. However, those skilled in the art will readily appreciate that the detailed description given herein with respect to these Figures is for explanatory purposes only and should not be construed as limiting.

According to some embodiments, for example as shown in FIG. 1, a watch 10 includes a watch body 12 that is worn on a wrist 2 with a watchband 20. Watch body 12 can be portable and attached to other body parts of the user or to other devices, structures, or objects. Watchband 20 can be flexible and encircle at least a portion of wrist 2 of a user. By securing watch body 12 to the person of the user, watchband 20 provides security and convenience. In some embodiments, watch body 12 includes a display 14 and a housing 16 for containing components.

Figure 2:
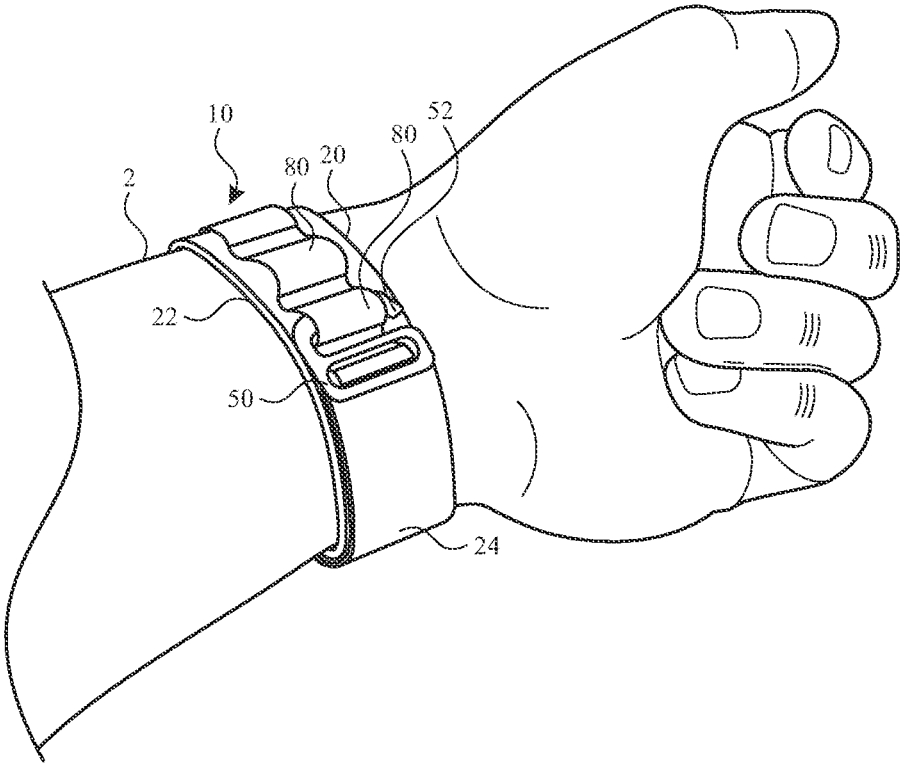
FIG. 2 is another perspective view of the watch of FIG. 1 on the wrist of the user, in accordance with some embodiments of the present disclosure.

According to some embodiments, for example as shown in FIG. 2, watchband 20 extends to an opposite side of wrist 2 of user from watch body 12. Watchband 20 includes an inner portion 22 and an outer portion 24 that overlap and engage each other. Watchband 20 can further include a buckle 50 at a free end thereof to facilitate manipulation of watchband 20 during attachment, adjustment, and/or removal thereof. For example, buckle 50 can include a hook 52 that is inserted into one of multiple loops 80 formed on inner portion 22 of watchband 20. By selecting which of loops 80 into which hook 52 is to be inserted and secured, the tightness of watchband 20 can be selected and/or adjusted as desired.

Figure 3:
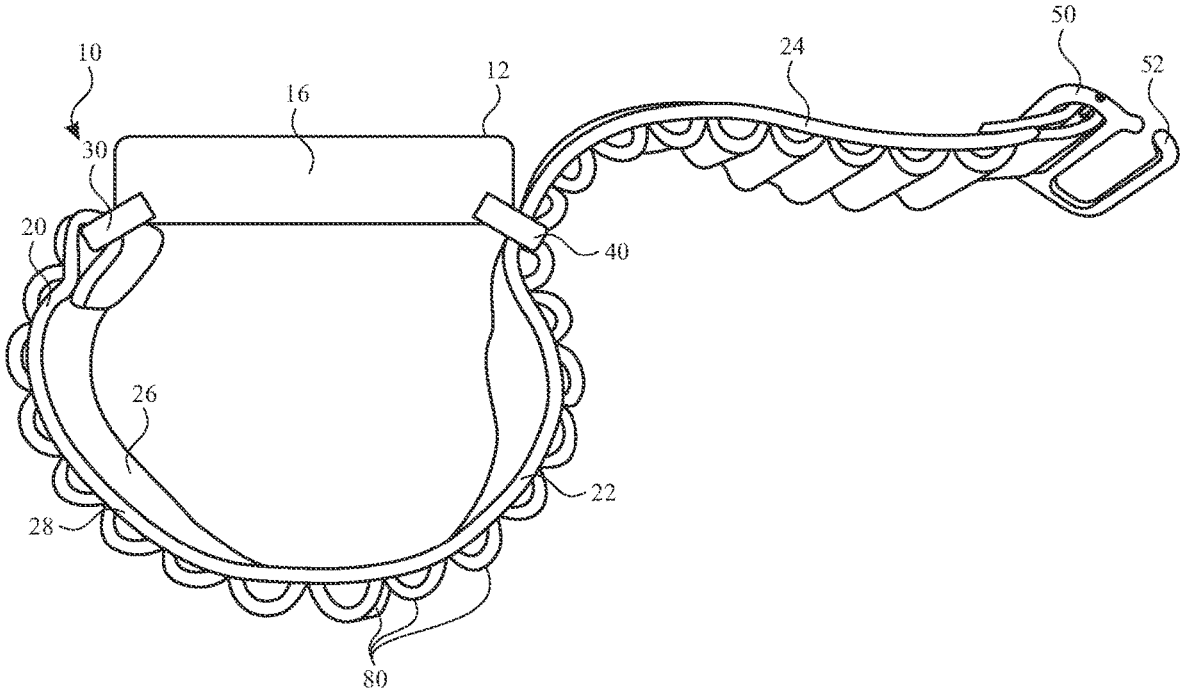
FIG. 3 is a side view of a watch with a watchband in a free configuration, in accordance with some embodiments of the present disclosure.
Figure 4:
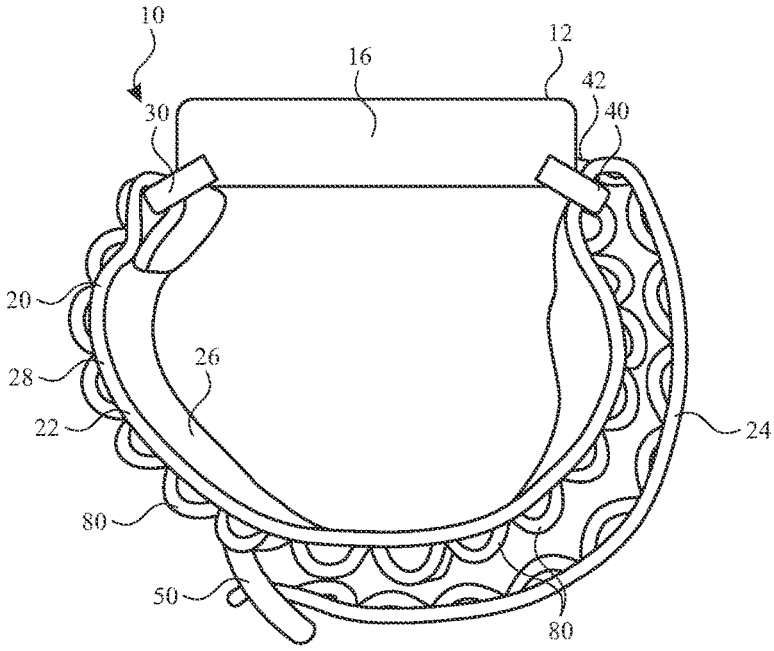
FIG. 4 is a side view of a watch with a watchband in a secured configuration, in accordance with some embodiments of the present disclosure.

According to some embodiments, for example as shown in FIGS. 3 and 4, watchband 20 is adjustable to fit securely and comfortably onto a wrist by selecting an extent of overlap between inner portion 22 and outer portion 24. For example, the diameter of watchband 20 is adjustable to be appropriate for a secure and comfortable fit on the wrist. Watchband 20 removably attaches to a portion of housing 16 of watch body 12 with a connector 30. Watchband 20 removably attaches to another portion of housing 16 of watch body 12 with a retaining ring 40. Accordingly, watchband 20 is removeable from watch body 12 and replaced, thereby permitting a user to switch watchbands as necessary or desired. A portion of a base 32 of watchband 20 passes through a hole of retaining ring 40, such that the length of inner portion 22 and the length of outer portion 24 are defined on either side of retaining ring 40.

A contact surface 26 of watchband 20 is positionable to contact the wrist of the user. Along inner portion 22, contact surface 26 faces inwardly toward the wrist. Along outer portion 24, contact surface 26 continues as an outwardly facing surface. An engagement surface 28 of watchband 20 is positionable to contact itself. Along inner portion 22, engagement surface 28 faces outwardly away from the wrist. Along outer portion 24, engagement surface 28 faces inwardly toward inner portion 22 and opposite the portion of engagement surface 28 that extends along inner portion 22. As shown in FIG. 4, buckle 50 having hook 52 is arranged to engage one of loops 80 on engagement surface 28 and along inner portion 22, as described further herein. Engagement surface 28 can be arranged to avoid contact with the wrist of the user.

According to some embodiments, for example as shown in FIGS. 3 and 4, connector 30 and a buckle 50 can be located at or near ends of watchband 20. Retaining ring 40 is slidably connected to base 32 of watchband 20 and provides a connection to housing 16 of watch body 12. Contact surface 26 extends between connector 30 and buckle 50. For example, contact surface 26 extends to connector 30 and/or buckle 50. Contact surface 26 need not provide loops extending from base 32, however these and other features can optionally be provided, as described further herein.

As shown in FIG. 4, retaining ring 40 can have an engagement end 44 and a retaining ring hole 42 through which base 32 of watchband 20 can extend. Buckle 50 has at least one cross-sectional dimension that is larger than at least one cross-sectional dimension of retaining ring hole 42. For example, buckle 50 can have a cross-sectional dimension (e.g., thickness), transverse to a longitudinal axis of watchband 20, that is larger than a cross-sectional dimension (e.g., thickness) of retaining ring hole 42. Retaining ring 40 further includes an engagement member for secure engagement with housing 16 of watch body 12. For example, the engagement member allows retaining ring 40 to securely engage housing 16 within a channel thereof. The engagement member can be the same as, similar to, or different from an engagement member of connector 30.

According to some embodiments, for example as shown in FIG. 4, engagement surface 28 extends between connector 30 and buckle 50. Engagement surface 28 includes an engagement ribbon 82 forming loops 80. Loops 80 extend from base 32 for engagement with hook 52 of buckle 50.

According to some embodiments, for example as shown in FIG. 4, watchband 20 slidably extends through retaining ring 40. The length of watchband 20 that extends on either side of retaining ring 40 can be adjusted as desired by a user for preferred comfort and grip on the wrist of the user. Buckle 50 can be sized and arranged to prevent passage through retaining ring 40 so that a portion of watchband 20 remains within at least a portion of retaining ring 40.

Figure 5:
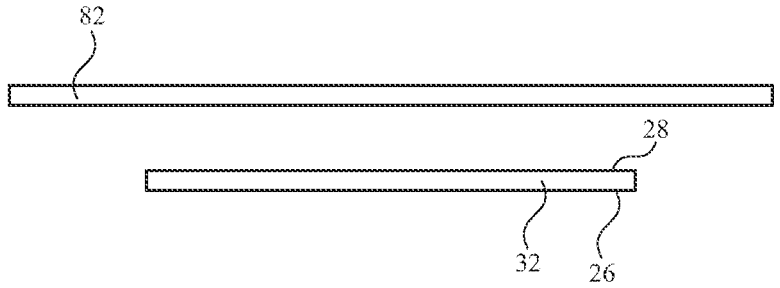
FIG. 5 is a side view of a watchband in a first stage of assembly, in accordance with some embodiments of the present disclosure.
Figure 6:
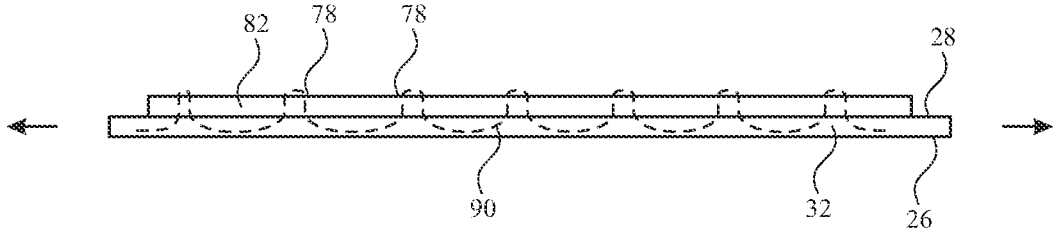
FIG. 6 is a side view of the watchband of FIG. 5 in a second stage of assembly, in accordance with some embodiments of the present disclosure.
Figure 7:
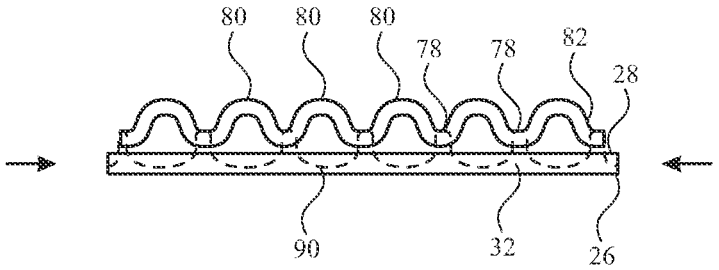
FIG. 7 is a side view of the watchband of FIGS. 5 and 6 in a third stage of assembly, in accordance with some embodiments of the present disclosure.

Referring now to FIGS. 5-7, the loops of a watchband can be formed based on the interaction between separate layers thereof. The separate layers can be coupled together at discrete coupling regions, between which the loops can be formed.

As shown in FIG. 5, engagement ribbon 82 can be provided alongside base 32. In some embodiments, each of engagement ribbon 82 and base 32 can be formed by woven materials, as described further herein. Engagement ribbon 82 can be disposed on a side of base 32, such as facing engagement surface 28, opposite contact surface 26. As further shown in FIG. 5, base 32 can have a length in a retracted or relaxed configuration that is shorter than in other configurations. Optionally, base 32 can have a length in the retracted or relaxed configuration that is shorter than a length of engagement ribbon 82.

As shown in FIG. 6, base 32 is configured to be elongated along a longitudinal axis thereof. When base 32 is elongated, engagement ribbon 82 can be provided to engagement surface 28 of base 32. Optionally, engagement ribbon 82 can be provided without undergoing elongation, significant tension, or other external forces. While base 32 is elongated, the length of base 32 can optionally exceed the length of engagement ribbon 82. As further shown in FIG. 6, a coupling thread 90 can be provided to couple engagement ribbon 82 to base 32. For example, coupling thread 90 can extend (e.g., longitudinally or otherwise) within base 32 until it arrives at or adjacent to coupling regions 78 of engagement ribbon 82. At coupling regions 78, coupling thread 90 can extend from base 32, through engagement surface 28, and into and/or through engagement ribbon 82. Coupling thread 90 can further extend out of coupling regions 78 of engagement ribbon 82, back through engagement surface 28, and into and/or through base 32. Coupling thread 90 can extend through base 32 until it arrives at the next longitudinally adjacent coupling regions 78. As such, coupling thread 90 can couple engagement ribbon 82 to base 32 at coupling regions 78, and coupling thread 90 can allow engagement ribbon 82 to be decoupled from base 32 at lengths between coupling regions 78.

In the example depicted in FIG. 6, base 32 is maintained in an elongated configuration under tension, while engagement ribbon 82 can be in a relaxed configuration. For example, one or more threads of base 32 can be stretched while under tension, but engagement ribbon 82 need not be placed under tension in such a configuration. It will be understood that one or more threads of base 32 can apply a counterforce or tension in response to an external force.

As shown in FIG. 7, base 32 can be allowed to retract longitudinally to a relaxed configuration. As base 32 retracts, the distance between each pair of longitudinally adjacent coupling regions 78 can shorten. As engagement ribbon 82 is not stretched under tension in the configuration of FIG. 6, the longitudinal retraction (e.g., shortening) of base 32 can allow loops 80 of engagement ribbon 82 to emerge and extend away from base 32. Each loop 80 can be formed between a pair of corresponding and longitudinally adjacent coupling regions 78.

In some embodiments, engagement ribbon 82 can be coupled to base 32 while base 32 is under tension, as illustrated in FIG. 6. In some embodiments, engagement ribbon 82 can be coupled to base 32 while base 32 is not under tension, as illustrated in FIG. 7. In such embodiments, support structures can be provided between engagement ribbon 82 and base 32 to form loops 80. For example, such support structures can be placed with gaps there between at locations for coupling regions 78.

While the retracted configuration of base 32 can result in the configuration depicted in FIG. 7, it will be understood that the base 32 can be stretched longitudinally to return to a configuration such as that depicted in FIG. 6. For example, when a watchband is placed under tension (e.g., while on a wrist of the user) base 32 can be stretched in response. In such a configuration, loops 80 can be collapsed toward base 32 as coupling regions 78 move away from each other. In some embodiments, while base 32 can include elastic threads to facilitate longitudinal elongation, engagement ribbon 82 can be formed from inelastic threads that limit longitudinal elongation of engagement ribbon 82. Accordingly, the inelastic threads of engagement ribbon 82 can limit the maximum distance between coupling regions 78 (i.e., when loops 80 are flattened against base 32), thereby setting a limit on the longitudinal elongation of the base 32. This can help protect base 32 by preventing it from extending beyond the elastic limit of its threads.

Figure 8:
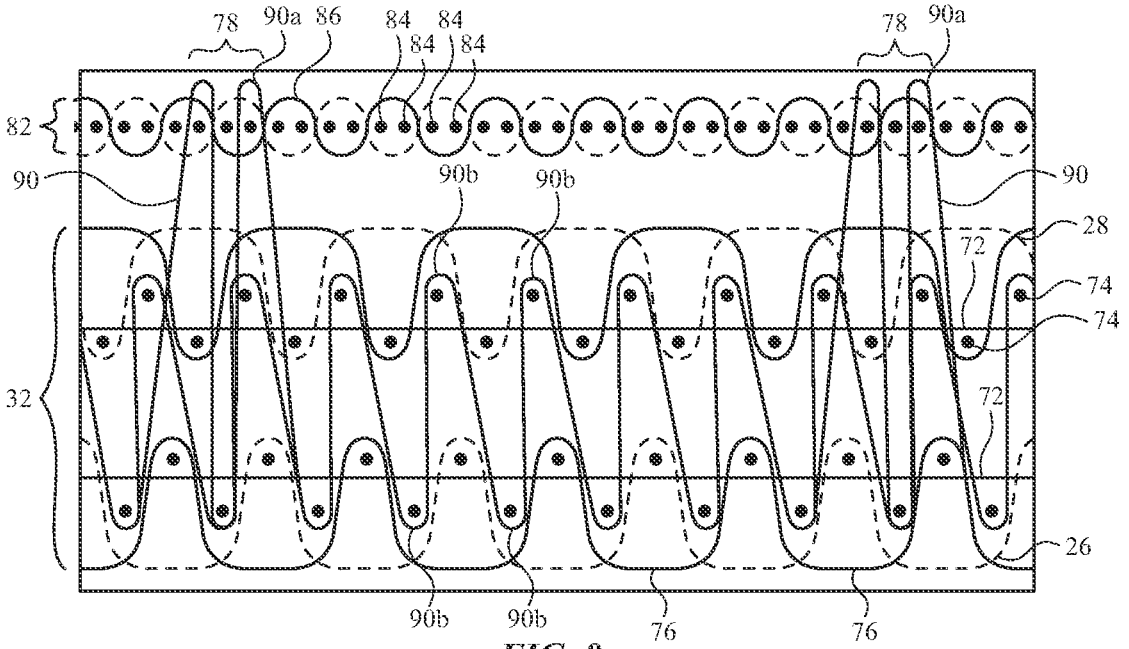
FIG. 8 is a sectional view of a watchband showing a weave pattern, in accordance with some embodiments of the present disclosure.

According to some embodiments, for example as shown in FIG. 8. Loops 80 are formed and arranged to enhance engagement with a buckle having a hook. For example, the shape, size, number, and distribution of loops 80 can facilitate ready and secure engagement with hooks. Such features are provided with a weave by which loops 80 are formed.

Where an engagement mechanism, such as a hook of a buckle (not shown) is engaged between engagement ribbon 82 and base 32, the longitudinal elongation of base 32 can cause loops 80 to collapse onto such engagement mechanism. As such, this can help increase engagement while the watchband is under tension (e.g., while worn by a user).

As used herein, a loop is defined by a length of a structure(s) that surrounds a closed space. Loops 80 can be formed by engagement ribbon 82, even when engagement ribbon 82 does not connect to itself to surround the closed spaces. For example, a "loop" of engagement ribbon 82 can extend from base 32 and return to base 32, such that engagement ribbon 82 and base 32 together surround a closed space.

Figure 9:
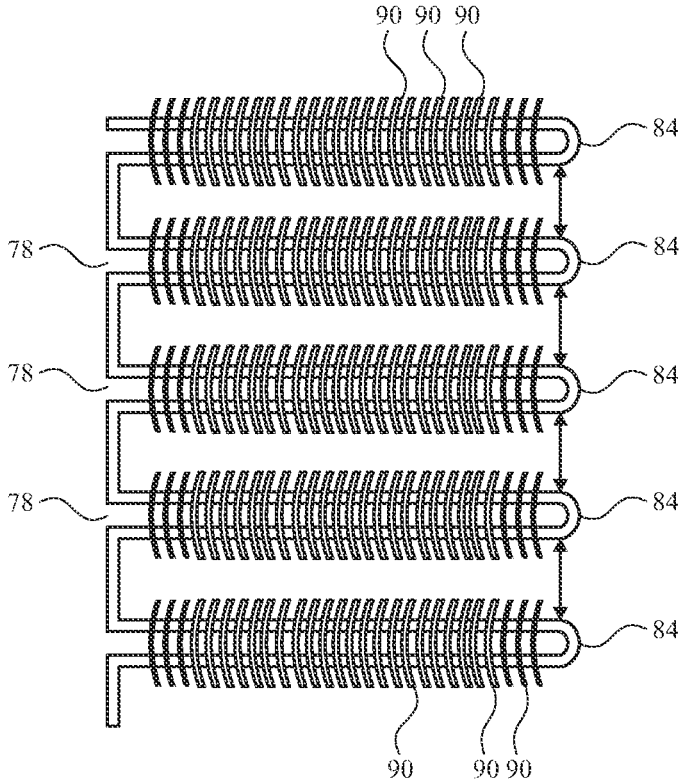
FIG. 9 is a top view of the watchband of FIG. 8, in accordance with some embodiments of the present disclosure.

Referring now to FIG. 8-9, a base and an engagement ribbon can have corresponding woven structures that are coupled to each other with a coupling thread that is interwoven with both woven structures.

According to some embodiments, for example as shown in FIG. 8, base 32 can be formed from base threads 74 and 76, which can include elastic threads 72. Elastic threads 72 can extend longitudinally, for example toward a connector (not shown) and/or a buckle (not shown) at longitudinal ends of watchband 20. The elastic threads can accommodate elongation of base 32 while applying an internal tension to return base 32 to a retracted and relaxed confirmation in the absence of an external force or tension. Base threads 74 and 76 can be elastic and/or inelastic. Base threads 74 and 76 can include, for example, weft and warp threads that extend transverse to elastic threads 72 and/or coupling threads 90. Elastic threads 72 can optionally turn and reverse direction at one or more ends of base 32 to make multiple passes across the woven structure of base 32. Base 32 can include one or more plies. For example, as shown in FIG. 8, base threads 74 and 76 and/or elastic threads 72 form multiple plies.

Engagement ribbon 82 can be provided above base 32. Loops of engagement ribbon 82 can be formed by lengths of engagement ribbon 82 between coupling regions 78 of engagement ribbon 82, where such lengths can extend away from and return to base 32.

According to some embodiments, for example as shown in FIG. 8, engagement ribbon 82 can be formed from engagement threads 84 and 86. Engagement threads 84 and 86 can include, for example, weft and warp threads that extend transverse to a longitudinal axis of engagement ribbon 82 and/or coupling threads 90. Engagement ribbon 82 can include one or more plies. For example, as shown in FIG. 8, engagement threads 84 and 86 form a single ply. In some embodiments, engagement threads 84 and 86 can be inelastic.

Engagement ribbon 82 can be coupled to base 32 at coupling regions 78. At coupling regions 78, coupling thread 90 can be interwoven with both base 32 and engagement ribbon 82. For example, coupling portions 90*a* of coupling thread 90 can extend through and/or about both base 32 (e.g., base threads 74 and 76 and/or elastic threads 72) and engagement ribbon 82 (e.g., engagement threads 84 and 86).

Within a given coupling region 78, coupling portion 90*a* of coupling thread 90 can make one or more passes through each of base 32 and engagement ribbon 82. For example, as shown in FIG. 8, coupling portion 90*a* of coupling thread 90 makes four passes (two in each of opposite directions) through each of base 32 and engagement ribbon 82, with a corresponding number of turns to change directions.

Between each pair of longitudinally adjacent coupling regions 78, hidden portions 90*b* of coupling thread 90 can extend exclusively through and/or about base 32 (e.g., base threads 74 and 76 and/or elastic threads 72). Each hidden portion 90*b* of coupling thread 90 (e.g., between a pair of longitudinally adjacent coupling regions 78) can be woven entirely within base 32 and extend between contact surface 26 and/or engagement surface 28. In some embodiments, hidden portions 90*b* extend to and define a portion of contact surface 26 and/or engagement surface 28. In some embodiments, base threads 74 and/or 76 cover hidden portions 90*b*, such that base threads 74 and/or 76 entirely define contact surface 26 and/or engagement surface 28.

Each turn of coupling thread 90 can allow the next length of coupling thread 90 to pass beyond a next one of base threads 74 and/or engagement threads 84 (where applicable in coupling regions 78). As such, adjacent lengths of coupling thread 90 on either side of a turn can pass on opposing sides of one of base threads 74 and/or engagement threads 84.

Base 32 can be stretched longitudinally to increase the longitudinal spacing between coupling regions 78. Elastics threads 72, extending longitudinally, can facilitate the stretching based on elastic properties of elastic threads 72. Coupling threads 90 can be woven into base 32 and engagement ribbon 82 as described herein while base 32 is in the stretched or elongated configuration and while engagement ribbon 82 is in a relaxed configuration. When base 32 returns to a non-stretched or relaxed configuration, loops 80 become elevated from base 32 due to the shortening between the locations at which loops 80 extend from base 32 (i.e., coupling regions 78).

As shown in FIG. 9, multiple coupling threads 90 can be woven to turn about each of multiple engagement threads 84 of engagement ribbon 82. Accordingly, engagement threads 84 can emerge to define a portion of an outer surface of engagement ribbon 82. Such appearance of coupling threads 90 can be exclusively within coupling regions 78. Between coupling regions 78, coupling threads 90 can be hidden within the base and allow loops to form.

Materials selected for the threads can be selected to facilitate the manufacture and use described herein. The threads can include natural and/or synthetic fibers. The threads can include a polymer, copolymer, or polymer blend. The threads can include nylon, polyester, polyurethane, and combinations thereof, including spandex. The threads can include single filaments and/or a bundle of yarn. Elastic threads 72 can be of a material that facilitates stretching. Base threads 74 and 76, engagement threads 84 and 86, and/or coupling threads 90 can be of the same or a similar material.

The watchband can be made in a variety of colors with visual effects that occur based on the design described herein. At least some of the base threads, the engagement threads, and the coupling threads can be of the same or different colors than other threads in the watchband. The several threads can be combined to produce custom color combinations as desired. The colors can be selected based on the appearance of certain threads in the weaving patterns described herein.

Figure 10:
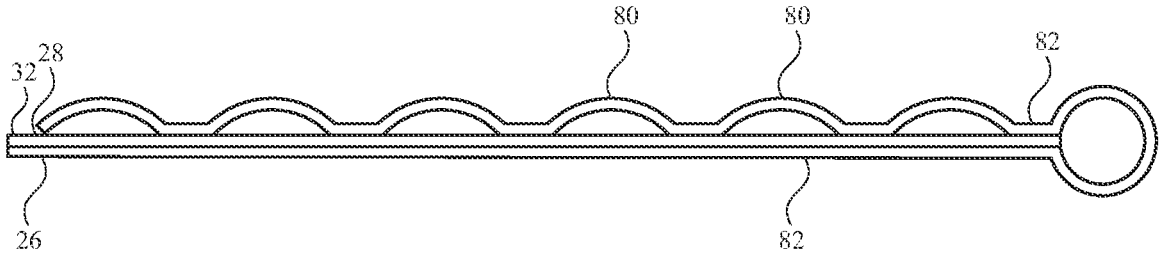
FIG. 10 is a side view of a watchband with loops on an engagement surface of a base, in accordance with some embodiments of the present disclosure.
Figure 11:
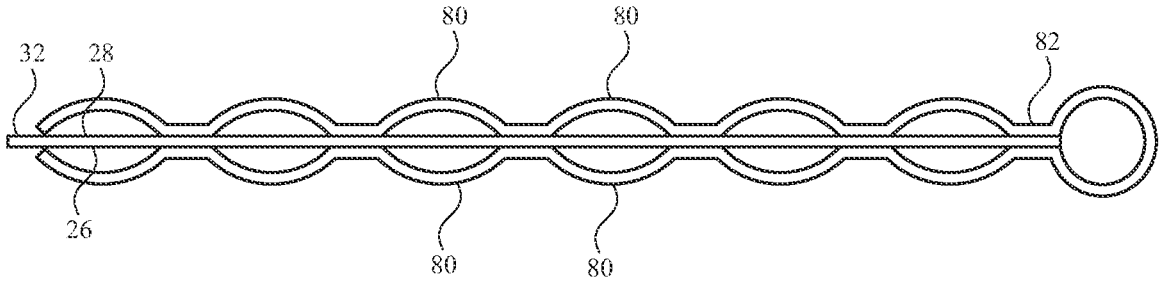
FIG. 11 is a side view of a watchband with loops on an engagement surface and a contact surface of a base, in accordance with some embodiments of the present disclosure.
Figure 12:
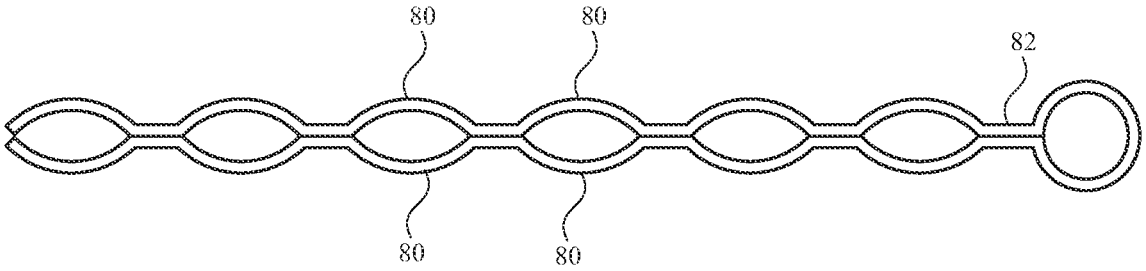
FIG. 12 is a side view of a watchband with loops formed without a base, in accordance with some embodiments of the present disclosure.

Referring now to FIGS. 10-12, arrangements of an engagement ribbon and a base can provide different structures for engagement. As shown in FIG. 10, engagement ribbon 82 can be coupled to engagement surface 28 of base 32. With such an arrangement, engagement ribbon 82 can form loops 80 extending away from engagement surface 28 of base 32. Additionally, engagement ribbon 82 can extend about an end of base 32 and along contact surface 26, opposite engagement surface 28 of base 32. As further shown in FIG. 10, engagement ribbon 82 need not form loops extending away from contact surface 26 of base 32. In some embodiments, engagement ribbon 82 can extend along the contact surface 26 to overlap with at least one of loops 80 extending away from engagement surface 28.

As shown in FIG. 11, engagement ribbon 82 can be coupled to engagement surface 28 and contact surface 26 of base 32. As such, engagement ribbon 82 can provide a continuous (e.g., woven) structure extending to both surfaces. Engagement ribbon 82 can form loops 80 extending away from both engagement surface 28 and contact surface 26 of base 32. Loops 80 can thereby extending opposite directions away from base 32. At least some of loops 80 on opposing sides of base 32 can be longitudinally aligned with each other to overlap. Accordingly, engagement ribbon 82 can be coupled to engagement surface 28 and contact surface 26 at similar locations.

As shown in FIG. 12, engagement ribbon 82 can overlap itself without requiring a support structures such as a base. Coupling regions 78 of engagement ribbon 82 can be coupled to each other, such that loops 80 can be formed where portions of engagement ribbon 82 overlap each other without being coupled together.

In any one or more of the arrangements described and depicted herein, the various structures and/or portions thereof can include elastic and/or inelastic materials to provide a desired amount of elongation in response to attention. For example, all, some, or no portion(s) of base 32 can include elastic materials. By further example, all, some, or no portion(s) of base 32 can include inelastic materials.

For example, all, some, or no portion(s) of engagement ribbon 82 can include elastic materials. By further example, all, some, or no portion(s) of engagement ribbon 82 can include inelastic materials.

Figure 13:
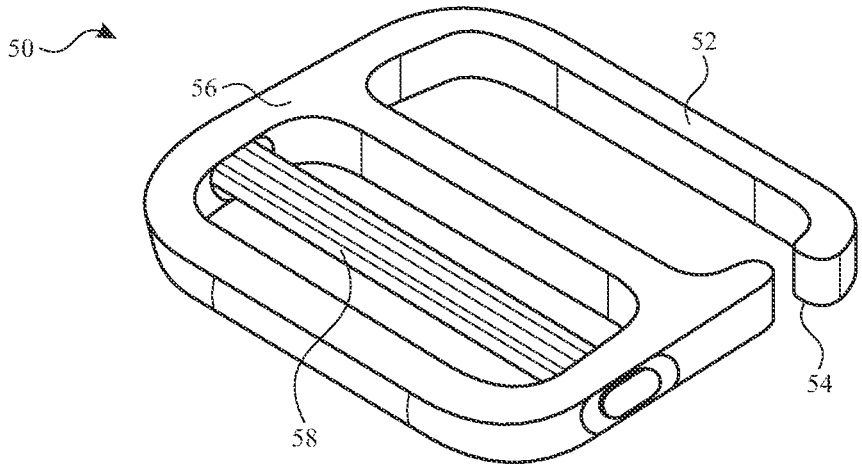
FIG. 13 is a perspective view of a buckle, in accordance with some embodiments of the present disclosure.
Figure 14:
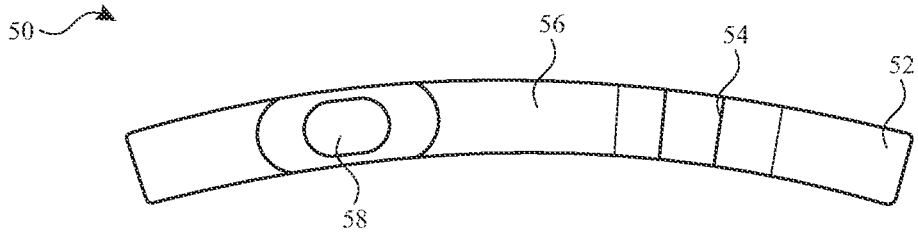
FIG. 14 is a side view of the buckle of FIG. 13, in accordance with some embodiments of the present disclosure.

Referring now to FIGS. 13-14, a buckle of a watchband can provide a mechanism for engaging a loop in a secure yet releasable configuration. As shown in FIGS. 13 and 14, buckle 50 can include a body 56 that defines hook 52. Hook 52 can extend laterally along an end of buckle 50. Hook 52 can terminate near an opening 54. When hook 52 is inserted into a loop, the loop can pass through opening 54 until portions of hook 52 are positioned on either side of the loop. Hook 52 can include a lateral portion for extending through a loop as well as longitudinal portions on either end of the lateral portion. The longitudinal portions can extend outside the loop, so that tension on the watchband helps maintain hook 52 within the loop.

Buckle 50 can further include a bar 58 coupled to the body 56. Bar 58 can be coupled to a base and/or an engagement ribbon of the watchband. In such a configuration, buckle 50 can rotate within a range of orientations with respect to the base and/or the engagement ribbon of the watchband. In some embodiments, bar 58 is securely coupled to body 56. In some embodiments, bar 58 is rotatably coupled to body 56, such that bar 58 can rotate to accommodate rotational movements of buckle 50. In some embodiments, bar 58 includes a spring-loaded pin for engaging body 56 and facilitating rotation of bar 58. Bar 58 can include a surface with desired texture and/or friction to control movement of material there across. Optionally, one or more caps can cover outer ends of bar 58 to provide a smooth outer surface alongside body 56.

Buckle 50, including body 56, hook 52, and/or bar 58, can include a rigid material. For example, buckle 50 can include a metal or plastic. The rigidity of buckle 50, particularly at hook 52, can facilitate insertion into loops of the watchband. Furthermore, the rigidity of buckle 50, particularly at hook 52, can facilitate retention of hook 52 within loops of the watchband until forcibly removed by a user.

Buckle 50 can, at least in part, form a structure that keeps a retaining ring on a base of a watchband. For example, buckle 50 has at least one cross-sectional dimension that is larger than at least one cross-sectional dimension of a retaining ring hole of a retaining ring.

Figure 15:
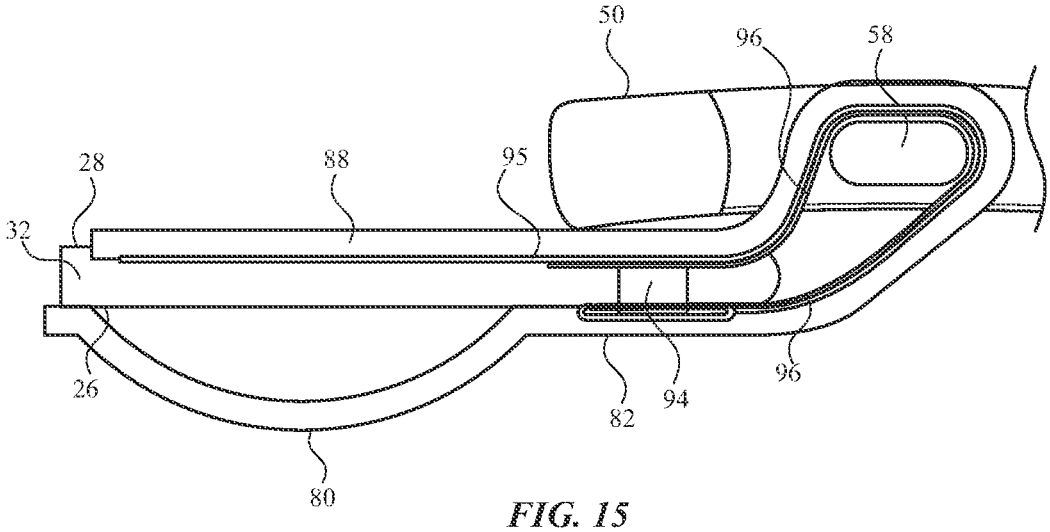
FIG. 15 is a side sectional view of a buckle coupled to a base and an engagement ribbon, in accordance with some embodiments of the present disclosure.

Referring now to FIG. 15, a buckle can be coupled to a base and/or an engagement ribbon at an end thereof. While the assembly described herein with respect to FIG. 15 is depicted for engagement with a buckle, it will be understood that such an assembly can be applied for engagement to a connector or other structure.

As shown in FIG. 15, base 32 can extend toward buckle 50 with an end thereof terminating near buckle 50. In some embodiments, base 32 need not extend around bar 58 or through any other portion of buckle 50. For example, a reinforcement strip 96 can extend from engagement surface 28 of the base 32, around bar 58 of buckle 50, and to contact surface 26 of base 32. Reinforcement strip 96 can be secured to each of engagement surface 28 and contact surface 26 of base 32 by a stitch 94. Stitch 94 can extend through base 32 to each overlapping portion of reinforcement strip 96. Reinforcement strip 96 can provide a lower thickness so that it can be coupled to bar 58 of buckle 50 with a lower profile than would be provided if base 32 were positioned around bar 58. For example, reinforcement strip 96 can be generally inextensible along a longitudinal length thereof, thereby providing high tensile strength along a long axis. By further example, reinforcement strip 96 can also provide high bendability to permit wrapping around bar 58. Reinforcement strip 96 can include fabric (e.g., taffeta), polymers, synthetic fibers, polyester, liquid crystal polymer (e.g., Vectran®), fiber glass, carbon fiber, and/or combinations thereof.

As further shown in FIG. 15, engagement ribbon 82 can extend from a side (e.g., engagement surface 28) of base 32 on which engagement ribbon 82 forms one or more loops 80. Engagement ribbon 82 can further extend about bar 58 and to contact surface 26 of base 32. Engagement ribbon 82 can cover reinforcement strip 96 and/or stitch 94. As such, reinforcement strip 96 and/or stitch 94 can be hidden from view. Engagement ribbon 82 can be interwoven with base 32 on engagement surface 28 thereof. On contact surface 26, an end portion 88 of engagement ribbon 82 can be coupled to base 32 along contact surface 26. However, end portion 88 of engagement ribbon 82 need not be coupled as securely to base 32 as was reinforcement strip 96. Where reinforcement strip 96 is provided, reinforcement strip 96 can be securely coupled to base 32 with stitch 94 such that tension can be applied to base 32 and securement to bar 58 of buckle 50 can be maintained. At the same time, engagement ribbon 82 need not resist such forces to maintain engagement with bar 58 of buckle 50. As such, end portion 88 of engagement ribbon 82 can be coupled to base 32 (e.g., at contact surface 26) with an adhesive 95 or other securing mechanism (e.g., stitch, overmolding, bonding, fusing, and the like).

Figure 16:
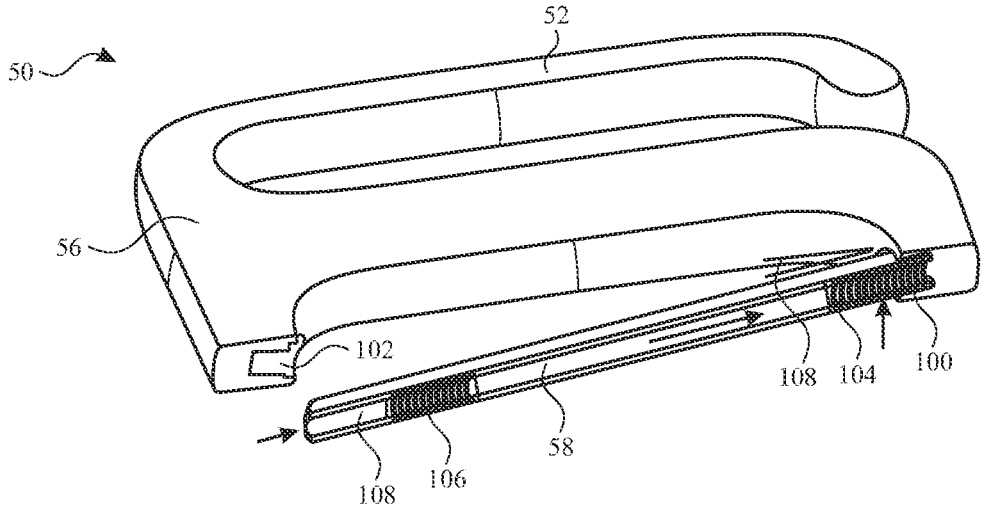
FIG. 16 is a perspective sectional view of a buckle in a first stage of assembly, in accordance with some embodiments of the present disclosure.
Figure 17:
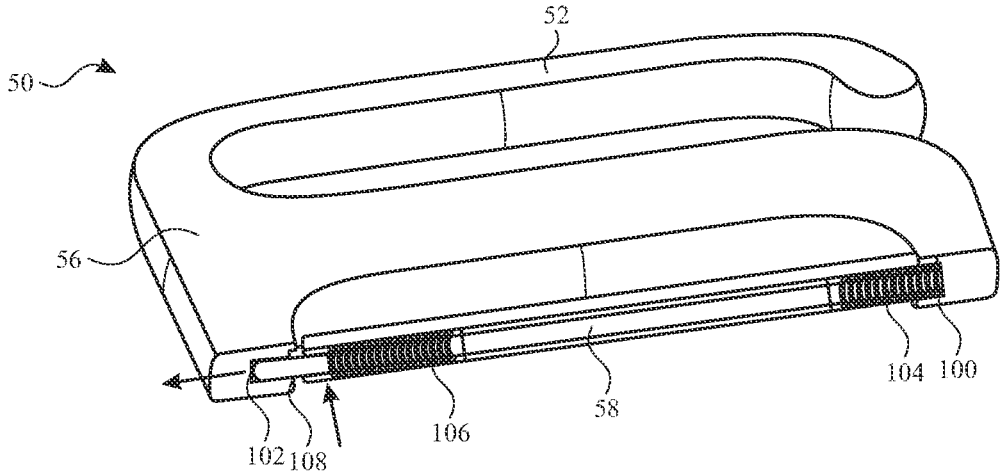
FIG. 17 is a perspective sectional view of the buckle of FIG. 16 in a second stage of assembly, in accordance with some embodiments of the present disclosure.
Figure 18:
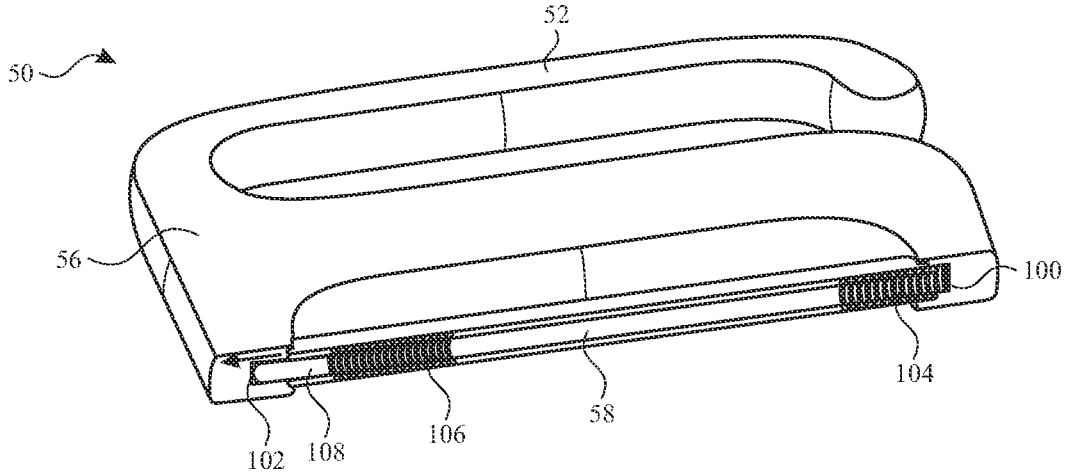
FIG. 18 is a perspective sectional view of the buckle of FIGS. 16 and 17 in a third stage of assembly, in accordance with some embodiments of the present disclosure.

Referring now to FIGS. 16-18, a bar can be secured within a body of a buckle with spring biasing to facilitate assembly. As shown in FIG. 16, body 56 of buckle 50 can define first recess 100 and second recess 102 facing inwardly towards each other. Bar 58 can include a first spring 104 at a first end of bar 58. Bar 58 can further include a second spring 106 and a pin 108 at a second end of bar 58. As shown in FIG. 16, the first end of bar 58 can be inserted into the first recess 100 of body 56. The first end of bar 58 can be inserted against a biasing force of first spring 104 when the first end is inserted into the first recess 100. As further shown in FIG. 16, pin 108 at the second end of bar 58 can be moved against a biasing force of second spring 106 in preparation for insertion of the second end of bar 58 into second recess 102.

As shown in FIG. 17, bar 58 can be rotated within first recess 100 until pin 108 is aligned with second recess 102. The corresponding shapes of the first end of bar 58 and first recess 100 can accommodate such rotation without requiring removal of the first end of bar 58 from first recess 100. When pin 108 is aligned with second recess 102, pin 108 can be allowed to advance under the biasing force of second spring 106. In such a configuration, further rotation can be prevented and/or limited by the engagement of pin 108 within second recess 102.

As shown in FIG. 18, bar 58 can be allowed to advance away from first recess 100 and into second recess 102. Such actions can be facilitated by the biasing force of first spring 104 between bar 58 and first recess 100. As the second end of bar 58 enters second recess 102, the first end of bar 58 can remain within first recess 100. Accordingly, bar 58 can be simultaneously engaged within both first recess 100 and second recess 102 to prevent and/or limit removal of bar 58 from body 56. It will be understood that from the configuration depicted in FIG. 18, bar 58 can move to the configuration depicted in FIG. 17. However, such movement can be achieved without permitting bar 58 from disengaging from body 56 of buckle 50. Additionally, bar 58 can be allowed to rotate with respect to body 56 in either the configurations of FIG. 17 or FIG. 18.

Referring now to FIGS. 19-28, a buckle can optionally include a gate that controllably closes across an opening defined, at least in part, by a hook of the buckle. Such a gate can prevent engagement or disengagement of the buckle from a loop until acted upon by a user. It will be understood that any one or more of the configurations depicted in FIGS. 19-28 can be combined with other features of a watchband that are disclosed herein.

Figure 19:
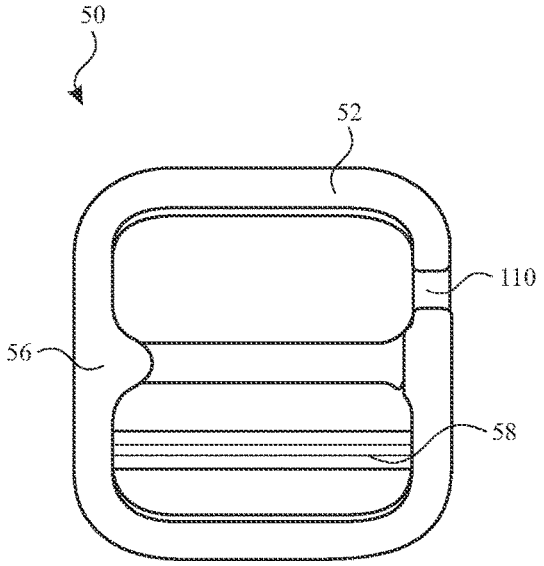
FIG. 19 is a top view of a buckle in a closed configuration, in accordance with some embodiments of the present disclosure.
Figure 20:
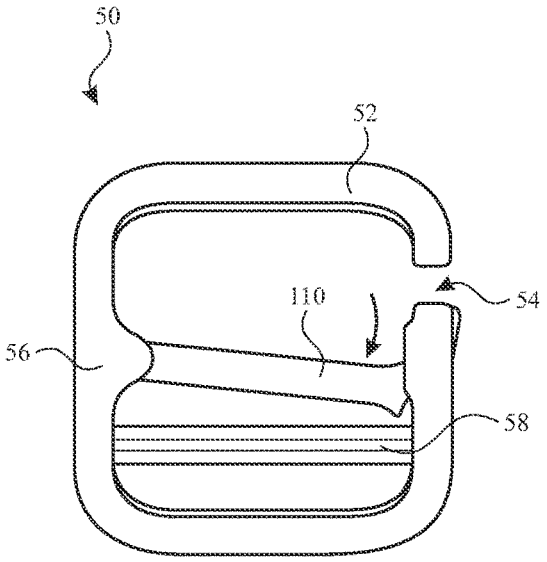
FIG. 20 is a top view of the buckle of FIG. 19 in an open configuration, in accordance with some embodiments of the present disclosure.

As shown in FIGS. 19 and 20, buckle 50 can include body 56 that defines hook 52. As shown in FIG. 19, a gate 110 can, in a closed configuration, extend from a portion of body 56 to hook 52, thereby preventing access to a space defined by hook 52. As shown in FIG. 20, gate 110 can be actuated by applying a force to a beam 116 (e.g., toward bar 58). Both beam 116 and gate 110 can rotate about a pivot 112 where beam 116 is rotatably coupled to body 56. In the depicted example, the beam 116 can remain substantially within a space defined by body 56, such that buckle 50 maintains a substantially low profile. As further shown in FIG. 20, rotation of gate 110 exposes opening 54 for allowing hook 52 to engage or disengage from a loop. Beam 116 and/or gate 110 can optionally be biased to the closed position depicted in FIG. 19, for example by a spring or other biasing mechanism of pivot 112.

Figure 21:
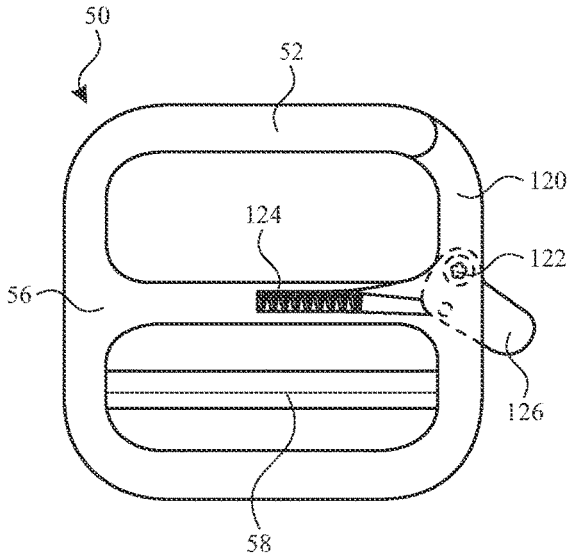
FIG. 21 is a top view of a buckle in a closed configuration, in accordance with some embodiments of the present disclosure.
Figure 22:
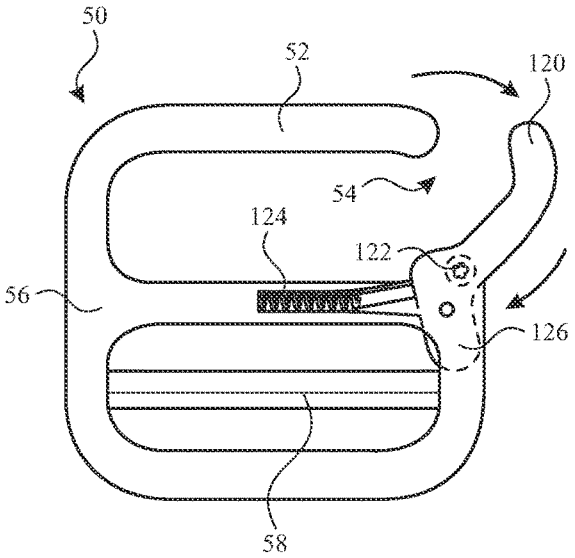
FIG. 22 is a top view of the buckle of FIG. 21 in an open configuration, in accordance with some embodiments of the present disclosure.

As shown in FIGS. 21 and 22, buckle 50 can include body 56 that defines hook 52. As shown in FIG. 21, a gate 120 can, in a closed configuration, extend from a portion of body 56 to hook 52, thereby preventing access to a space defined by hook 52. As shown in FIG. 22, gate 120 can be actuated by applying a force to a lever 126 (e.g., toward body 56). Both lever 126 and gate 120 can rotate about a pivot 122 where lever 126 and gate 120 are rotatably coupled to body 56. In the depicted example, the lever 126 can extend away from body 56 for access by a user. As further shown in FIG. 22, rotation of lever 126 and gate 120 exposes opening 54 for allowing hook 52 to engage or disengage from a loop. Lever 126 and/or gate 120 can optionally be biased to the closed position depicted in FIG. 21, for example by a spring 124 or other biasing mechanism, which can optionally be placed within an interior chamber of body 56.

Figure 23:
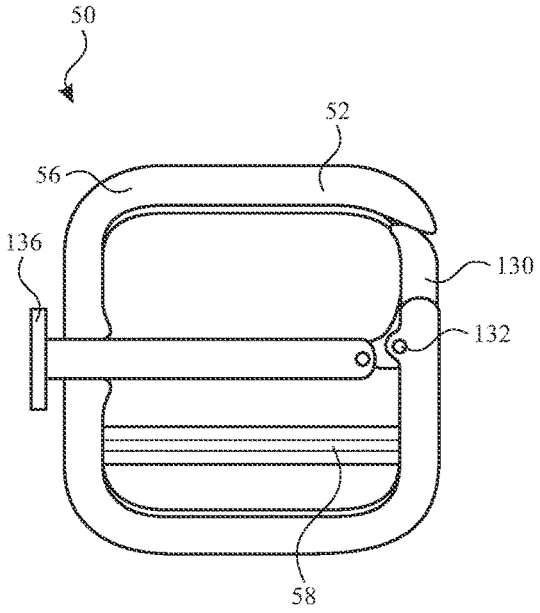
FIG. 23 is a top view of a buckle in a closed configuration, in accordance with some embodiments of the present disclosure.
Figure 24:
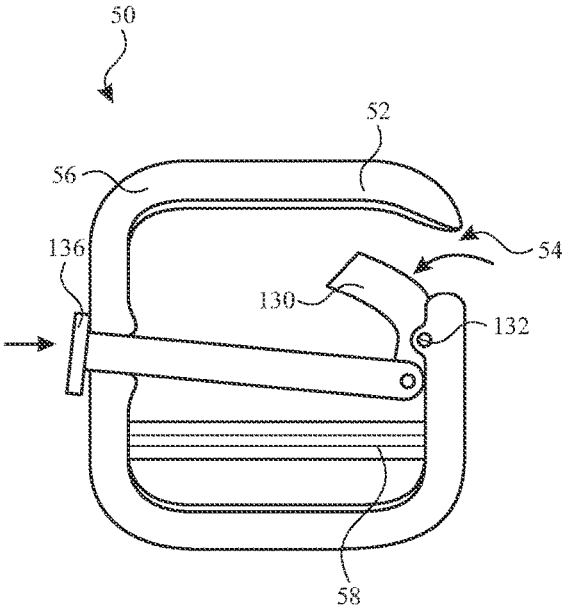
FIG. 24 is a top view of the buckle of FIG. 23 in an open configuration, in accordance with some embodiments of the present disclosure.

As shown in FIGS. 23 and 24, buckle 50 can include body 56 that defines hook 52. As shown in FIG. 23, a gate 130 can, in a closed configuration, extend from a portion of body 56 to hook 52, thereby preventing access to a space defined by hook 52. As shown in FIG. 24, gate 130 can be actuated by applying a force to a button 136 (e.g., alongside bar 58 and generally towards a pivot 132). Button 136 can move laterally across body 56, and gate 130 can rotate about pivot 132. As such, linear translation of button 136 can be converted to rotation of gate 130 about pivot 132. In the depicted example, a portion of button 136 can extend outside body 56 for access by a user, and another portion of button 136 can remain substantially within a space defined by body 56. Button 136 can be on a side of body 56 that is opposite a position of gate 130. As further shown in FIG. 24, rotation of gate 130 exposes opening 54 for allowing hook 52 to engage or disengage from a loop. Button 136 and/or gate 130 can optionally be biased to the closed position depicted in FIG. 23, for example by a spring or other biasing mechanism of pivot 132.

Figure 25:
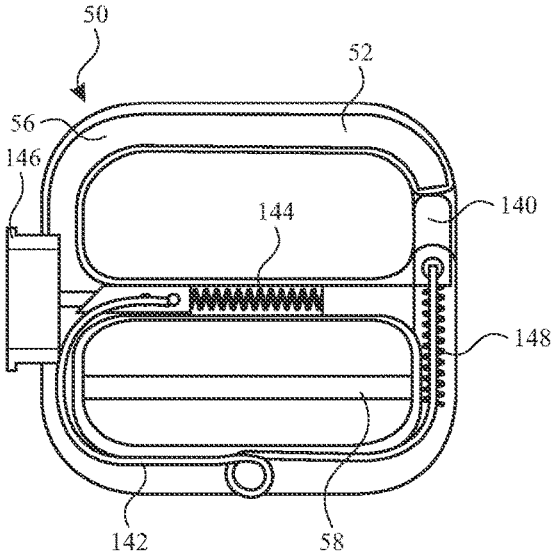
FIG. 25 is a top view of a buckle in a closed configuration, in accordance with some embodiments of the present disclosure.
Figure 26:
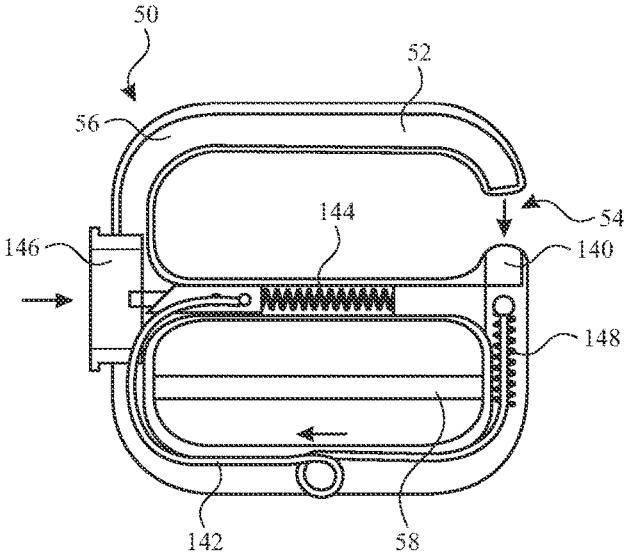
FIG. 26 is a top view of the buckle of FIG. 25 in an open configuration, in accordance with some embodiments of the present disclosure.

As shown in FIGS. 25 and 26, buckle 50 can include body 56 that defines hook 52. As shown in FIG. 25, a gate 140 can, in a closed configuration, extend from a portion of body 56 to hook 52, thereby preventing access to a space defined by hook 52. As shown in FIG. 26, gate 140 can be actuated by applying a force to a button 146 (e.g., alongside bar 58 and generally towards gate 140). Button 146 can be connected to gate 140 by a wire 142, which can extend within body 56. Linear translation of button 146 can be converted to linear translation of gate 140. As such, button 146 can move laterally across body 56, and gate 140 can move away from hook 52 and/or into body 56. In the depicted example, a portion of button 146 can extend outside body 56 for access by a user, and another portion of button 146 can remain substantially within a space defined by body 56. Button 146 can be on a side of body 56 that is opposite a position of gate 140. As further shown in FIG. 26, rotation of gate 140 exposes opening 54 for allowing hook 52 to engage or disengage from a loop. Button 146 can optionally be biased to the closed position depicted in FIG. 25, for example by a spring 144 or other biasing mechanism. Additionally or alternatively, gate 140 can optionally be biased to the closed position depicted in FIG. 25, for example by a spring 148 or other biasing mechanism.

Figure 27:
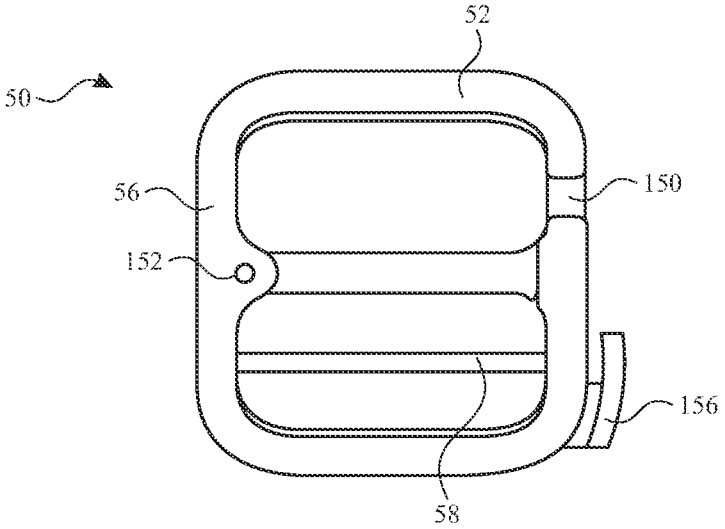
FIG. 27 is a top view of a buckle in a closed configuration, in accordance with some embodiments of the present disclosure.
Figure 28:
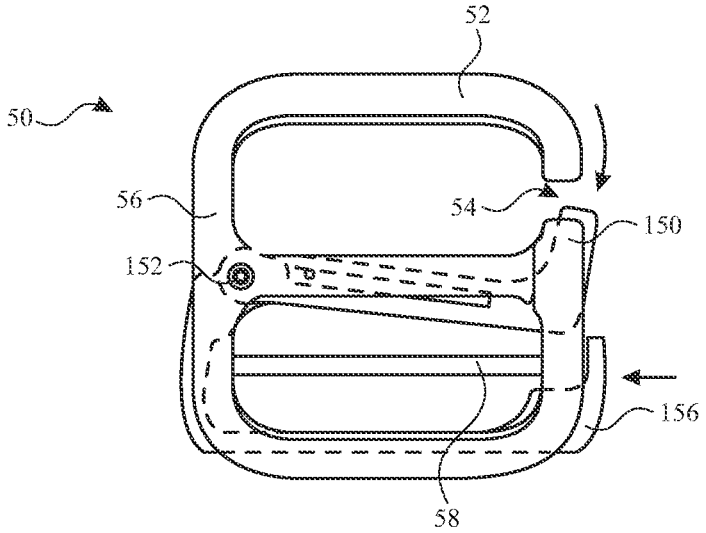
FIG. 28 is a top view of the buckle of FIG. 27 in an open configuration, in accordance with some embodiments of the present disclosure.

As shown in FIGS. 27 and 28, buckle 50 can include body 56 that defines hook 52. As shown in FIG. 27, a gate 150 can, in a closed configuration, extend from a portion of body 56 to hook 52, thereby preventing access to a space defined by hook 52. As shown in FIG. 28, gate 150 can be actuated by applying a force to a button 156 (e.g., alongside bar 58 and generally towards a pivot 152). Button 156 can move laterally across and/or within body 56, and gate 150 can rotate about pivot 152. As such, linear translation of button 156 can be converted to rotation of gate 150 about pivot 152. In the depicted example, a portion of button 156 can extend outside body 56 for access by a user, and another portion of button 156 can remain substantially within a space defined by body 56. Button 156 can be on a side of body 56 that is a same side as a position of gate 150. As further shown in FIG. 28, rotation of gate 150 exposes opening 54 for allowing hook 52 to engage or disengage from a loop. Button 156 and/or gate 150 can optionally be biased to the closed position depicted in FIG. 27, for example by a spring or other biasing mechanism of pivot 152.

Figure 29:
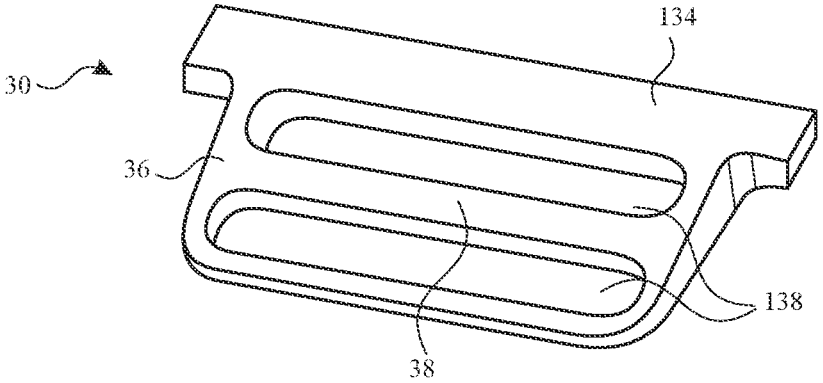
FIG. 29 is a perspective view of a buckle, in accordance with some embodiments of the present disclosure.
Figure 30:
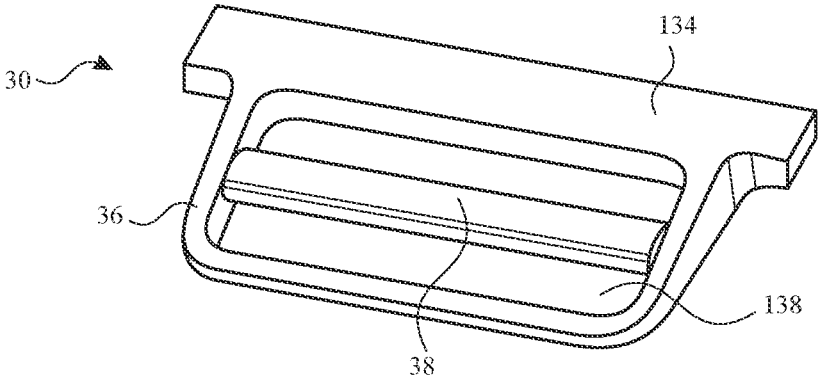
FIG. 30 is a perspective view of a buckle, in accordance with some embodiments of the present disclosure.
Figure 31:
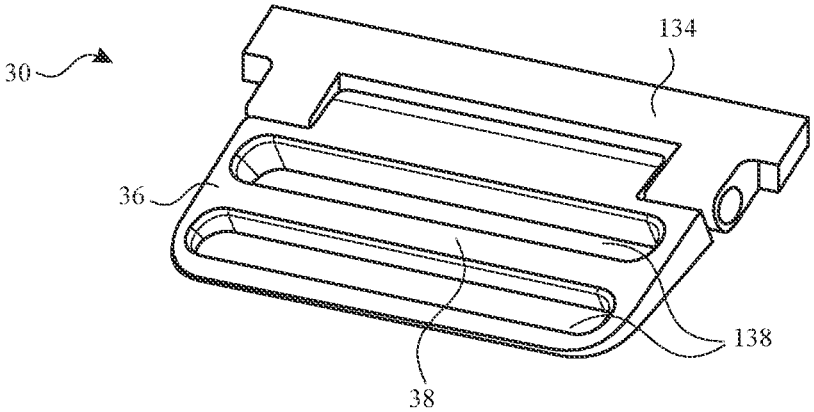
FIG. 31 is a perspective view of a buckle, in accordance with some embodiments of the present disclosure.

Referring now to FIGS. 29-31, a connector can be provided with one or more engagement mechanisms for coupling to an end of a watchband. For example, as shown in FIG. 29, a connector 30 can include an engagement end 134 for removably attaching to a portion of the housing of a watch body. Connector 30 can further include a connector hole 138 through which a base of a watchband can extend. In some embodiments, only one connector hole 138 need be provided, and the base can extend around a portion of the connector 30 that defines connector hole 138. In some embodiments, connector 30 can define two or more connector holes 138. For example, as further shown in FIG. 29, a bar 38 can extend across a portion of connector 30 to separate and define multiple connector holes 138. In some embodiments, bar 38 can be integrally formed with other components of connector 30.

As shown in FIG. 30, connector 30 can include bar 38 that is separately formed and coupled to a body 36 of connector 30. In some embodiments, bar 38 is securely coupled to body 36. In some embodiments, bar 38 is rotatably coupled to body 36, such that bar 58 can rotate to accommodate rotational movements of connector 30. In some embodiments, bar 38 includes a spring-loaded pin for engaging body 36 and facilitating rotation of bar 38. Bar 38 can include a surface with desired texture and/or friction to control movement of material there across. Optionally, one or more caps can cover outer ends of bar 38 to provide a smooth outer surface alongside body 36.

As shown in FIG. 31, body 36 of connector 30 can be rotatably coupled to engagement end 134, such that body 36 can accommodate rotational movements for alignment with a base. In some embodiments, body 36 includes a spring-loaded pin for engaging engagement end 134 and facilitating rotation of body 36.

Referring now to FIGS. 32-35, a watchband can be provided with a secure engagement between a base and a connector and/or buckle. While the assembly described herein with respect to FIGS. 32-35 is depicted for engagement with a connector, it will be understood that such an assembly can be applied for engagement to a buckle or other structure.

Figure 32:
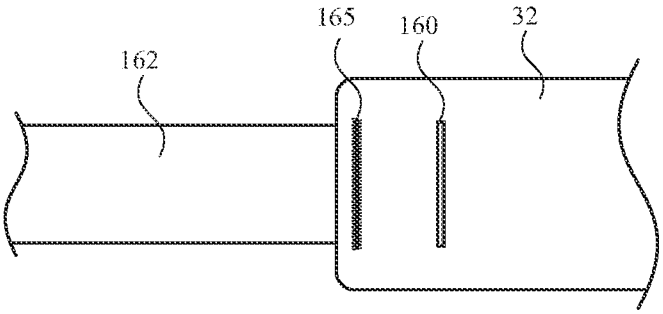
FIG. 32 is a top sectional view of a base in a first stage of assembly, in accordance with some embodiments of the present disclosure.

As shown in FIG. 32, a watchband can be formed with base 32 and an end portion 162 extending from an end of base 32. End portion 162 can be coupled to base 32, for example, with stitch 165. End portion 162 can have one or more features that are different from base 32. For example, end portion 162 can be narrower or thinner than base 32 in one more dimensions (e.g., thickness, width, etc.). As used herein, the thickness is measured in a dimension that is transverse to a longitudinal axis of the watchband and extends from and through (e.g., orthogonal to) the substantially flat surfaces, for example, of base 32 and/or end portion 162. It will be understood that the thickness of one structure is to be measured in the same or a parallel axis as the thickness of another structure. As used herein, the width is measured in a dimension that is transverse to a longitudinal axis of the watchband and extends across (e.g., parallel to) the substantially flat surfaces, for example, of base 32 and/or end portion 162. Base 32 can define an opening 160 extending therethrough (e.g., to opposing surfaces thereof). Opening 160 can have a width and/or thickness that is approximately the same as or greater than a width or thickness of end portion 162. End portion 162 can provide a lower thickness so that it can be coupled to connector 30 with a low profile. For example, end portion 162 can be generally inextensible along a longitudinal length thereof, thereby providing high tensile strength along a long axis. By further example, end portion 162 can also provide high bendability to permit wrapping around connector 30. End portion 162 can include fabric (e.g., taffeta), polymers, synthetic fibers, polyester, liquid crystal polymer (e.g., Vectran©), fiber glass, carbon fiber, and/or combinations thereof.

Figure 33:
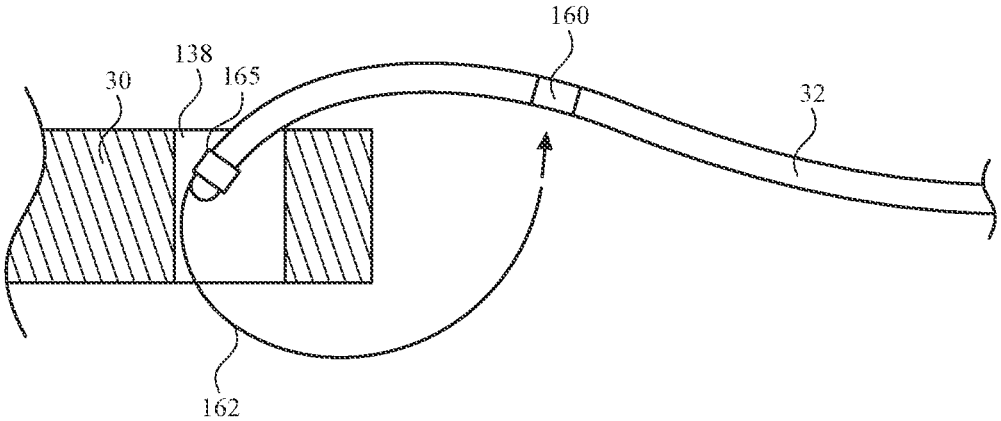
FIG. 33 is a side sectional view of a connector coupled to the base of FIG. 32 in a second stage of assembly, in accordance with some embodiments of the present disclosure.

As shown in FIG. 33, end portion 162 can pass through connector hole 138 of connector 30. After passing through connector hole 138, end portion 162 can be brought to opening 160 of base 32 to be passed therethrough. As end portion 162 continues through and past opening 160, base 32 can also pass through connector hole 138 until base 32 at least partially surrounds a portion of connector 30. For example, end portion 162 can be pulled through opening 160 with a force adequate to draw base 32 and/or end portion 162 entirely about a portion of connector 30 in a tight engagement.

Figure 34:
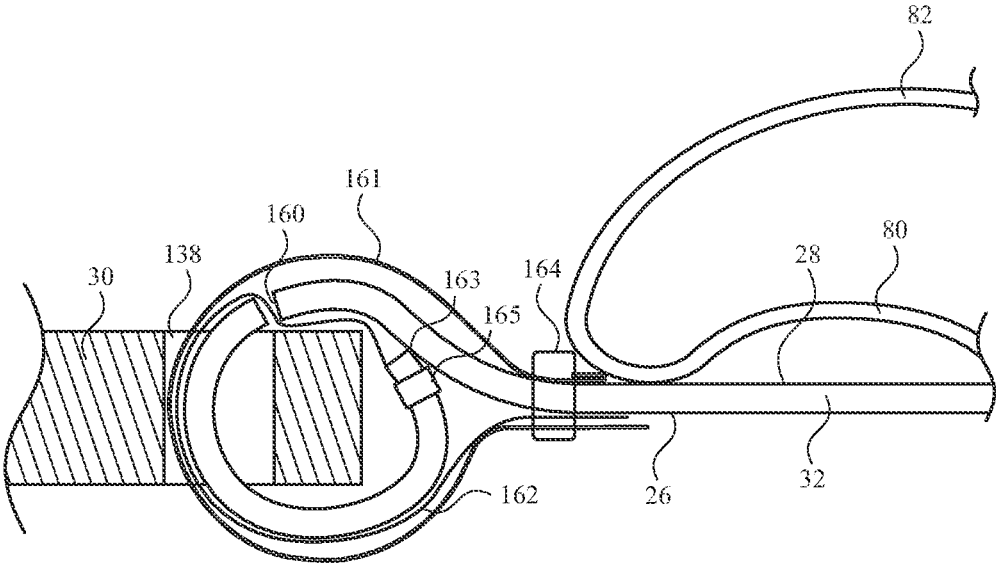
FIG. 34 is a side sectional view of the connector and the base of FIGS. 32 and 33 in a third stage of assembly, in accordance with some embodiments of the present disclosure.

As shown in FIG. 34, base 32 can be secured to itself in an overlapping portion close to connector 30. For example, base 32 can overlap itself and be secured to itself with an adhesive 163 and/or one or more of a variety of other mechanisms, such as a stitch, overmolding, bonding, fusing, and the like. Additionally or alternatively, the overlapping portions of base 32 and end portion 162 can be affixed to each other, so that end portion 162 is not removed from opening 160 and base 32 is not removed from connector hole 138 and released from connector 30. For example, the overlapping portions of base 32 and end portion 162 (e.g., at contact surface 26) can be secured to each other with a stitch 164 that extends at least partially through each of the overlapping portions of base 32 and end portion 162. Optionally, stitch 164 can extend to exterior surfaces of one or more of the overlapping portions of base 32, including engagement surface 28 and/or contact surface 26.

Figure 35:
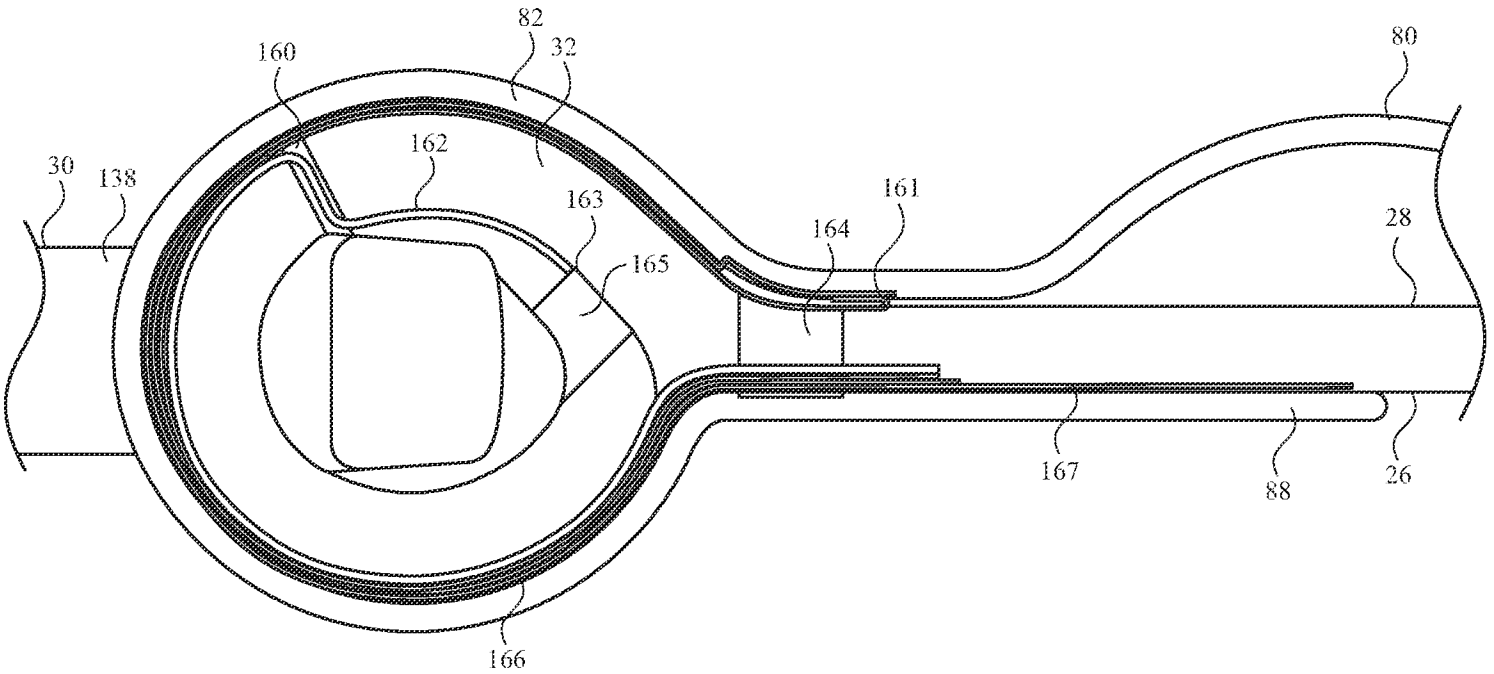
FIG. 35 is a side sectional view of the connector coupled to the base and the engagement ribbon of FIGS. 32-34 in a fourth stage of assembly, in accordance with some embodiments of the present disclosure.

In some embodiments, as shown in FIG. 35, additional structure can be provided to strengthen engagement to connector 30. For example, a reinforcement strip 161 can extend from engagement surface 28 of the base 32, around a portion of connector 30, and to contact surface 26 of base 32. Reinforcement strip 161 can be secured to each of engagement surface 28 and contact surface 26 of base 32 by stitch 164. Stitch 164 can extend through base 32 and end portion 162 to each overlapping portion of reinforcement strip 161. Reinforcement strip 161 can be generally inextensible along a longitudinal length thereof, thereby providing high tensile strength along a long axis. By further example, reinforcement strip 161 can also provide high bendability to permit wrapping around connector 30. Reinforcement strip 161 can include fabric (e.g., taffeta), polymers, synthetic fibers, polyester, liquid crystal polymer (e.g., Vectran©), fiber glass, carbon fiber, and/or combinations thereof.

As further shown in FIG. 34, the watchband can further include engagement ribbon 82 for covering at least a portion of stitch 164 and base 32. Engagement ribbon 82 can extend from a side (e.g., engagement surface 28) of base 32 on which engagement ribbon 82 forms one or more loops 80. Engagement ribbon 82 can be coupled to base 32 to form loops 80 on engagement surface 28. Engagement ribbon 82 can be provided with adhesive on a surface thereof that faces base 32.

As shown in FIG. 35, engagement ribbon 82 passes through connector hole 138 of connector 30, such that engagement ribbon 82 covers portions of base 32, end portion 162, reinforcement strip 161, and stitch 164. Engagement ribbon 82 can further extend about connector 30 and to contact surface 26 of base 32. As such, reinforcement strip 161 and/or stitch 94 can be hidden from view. Engagement ribbon 82 can be interwoven with base 32 on engagement surface 28 thereof. On contact surface 26, an end portion 88 of engagement ribbon 82 can be coupled to base 32 along contact surface 26. However, end portion 88 of engagement ribbon 82 need not be coupled as securely to base 32 as was reinforcement strip 161. Where reinforcement strip 161 is provided, reinforcement strip 161 can be securely coupled to base 32 with stitch 164 such that tension can be applied to base 32 and securement to connector 30 can be maintained. Reinforcement strip 161 can extend from a first location between engagement ribbon 82 and engagement surface 28 of base 32, about end portion 162, and to a second location between engagement ribbon 82 and contact surface 26 of base 32. At the same time, engagement ribbon 82 need not resist such forces to maintain engagement with connector 30. As such, end portion 88 of engagement ribbon 82 can be coupled to base 32 (e.g., at contact surface 26) with adhesive 166 or other securing mechanism (e.g., stitch, overmolding, bonding, fusing, and the like).

Figure 36:
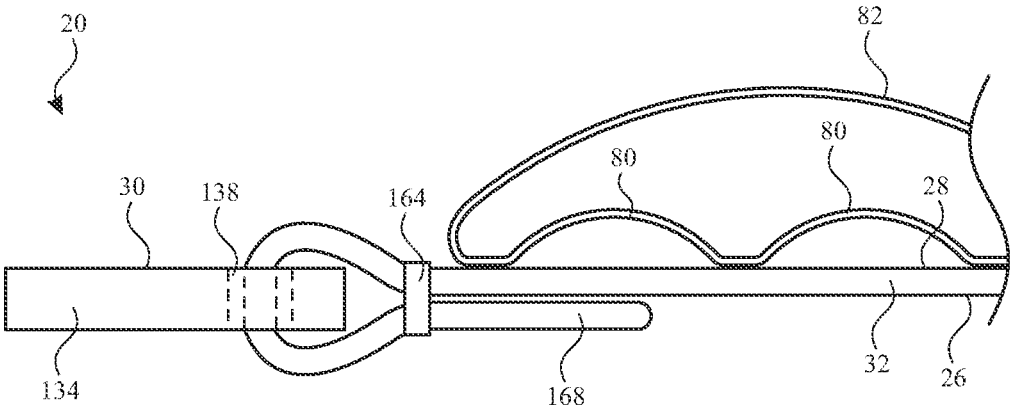
FIG. 36 is a side view of a connector coupled to a base in a first stage of assembly, in accordance with some embodiments of the present disclosure.
Figure 37:
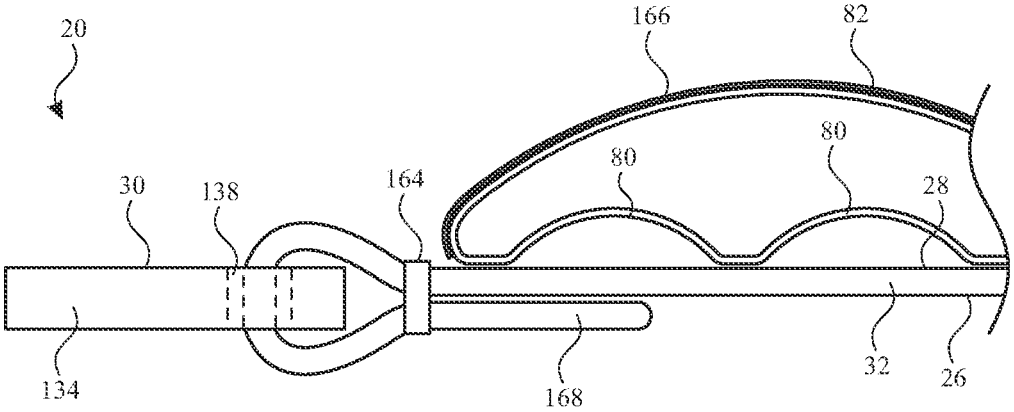
FIG. 37 is a side view of the connector coupled to the base of FIG. 36 in a second stage of assembly, in accordance with some embodiments of the present disclosure.
Figure 38:
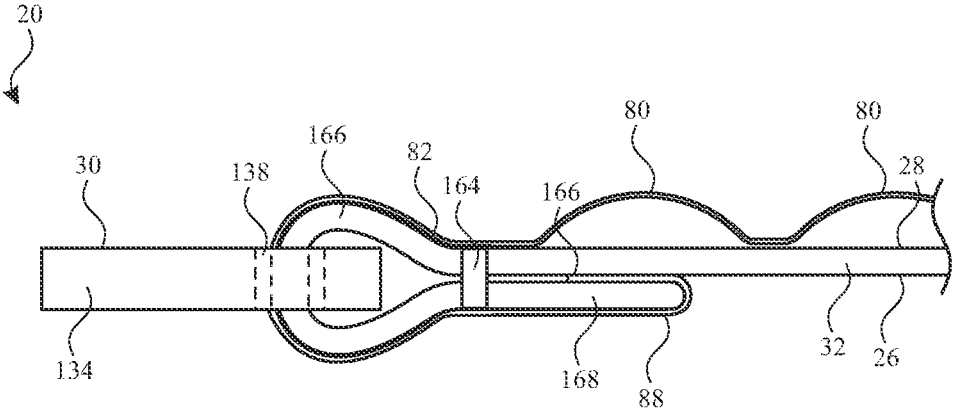
FIG. 38 is a side view of the connector coupled to the base of FIGS. 36 and 37 in a third stage of assembly, in accordance with some embodiments of the present disclosure.

Referring now to FIGS. 36-38, an end of the watchband can provide a connector for engaging a watch body. While the assembly described herein with respect to FIGS. 36-38 is depicted for engagement with a connector, it will be understood that such an assembly can be applied for engagement to a buckle or other structure.

According to some embodiments, for example as shown in FIG. 36, base 32 can be coupled to connector 30. Connector 30 can include an engagement end 134 for removably attaching to a portion of the housing of the watch body. Connector 30 can further include a connector hole 138 through which base 32 of watchband 20 can extend. For example, as shown in FIG. 36, end portion 168 of base 32 passes through connector hole 138 of connector 30, such that end portion 168 of base 32 overlaps other portions of base 32. The overlapping portions of base 32 can be affixed to each other, so that base 32 is not removed from connector hole 138 and released from connector 30. For example, the overlapping portions of base 32, including end portion 168, can be secured to each other with a stitch 164 that extends at least partially through each of the overlapping portions. Optionally, stitch 164 can extend to exterior surfaces of one or more of the overlapping portions of base 32. In some embodiments, stitch 164 can extend to end portion 168.

As shown in FIG. 37, watchband 20 can further include engagement ribbon 82 for covering at least a portion of stitch 164 and base 32. Engagement ribbon 82 can be coupled to base 32 to form loops 80 on engagement surface 28. Engagement ribbon 82 can be provided with adhesive 166.

As shown in FIG. 38, engagement ribbon 82 passes through connector hole 138 of connector 30, such that engagement ribbon 82 covers portions of base 32, including end portion 168 as well as stitch 164. At least an end portion of engagement ribbon 82 can be positioned between the overlapping portions of base 32 (including end portion 168). Adhesive 166 can affix engagement ribbon 82 to base 32. Adhesive 166 (and/or another portion of adhesive) can affix overlapping portions of base 32 (including end portion 168) to each other and/or engagement ribbon 82. Additionally or alternatively, fixation can be provided by one or more of a variety of mechanisms. For example, the materials of base 32 and/or engagement ribbon 82 can be bonded (e.g., melted) to each other along the overlapping portions.

Figure 39:
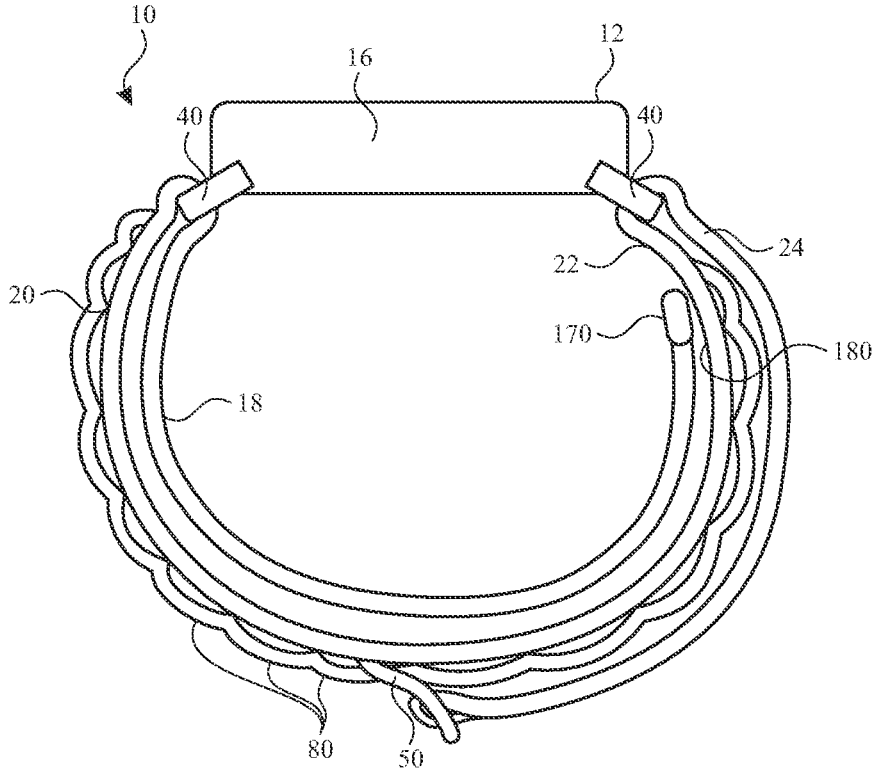
FIG. 39 is a side view of a watch with a watchband in a secured configuration, in accordance with some embodiments of the present disclosure.
Figure 40:
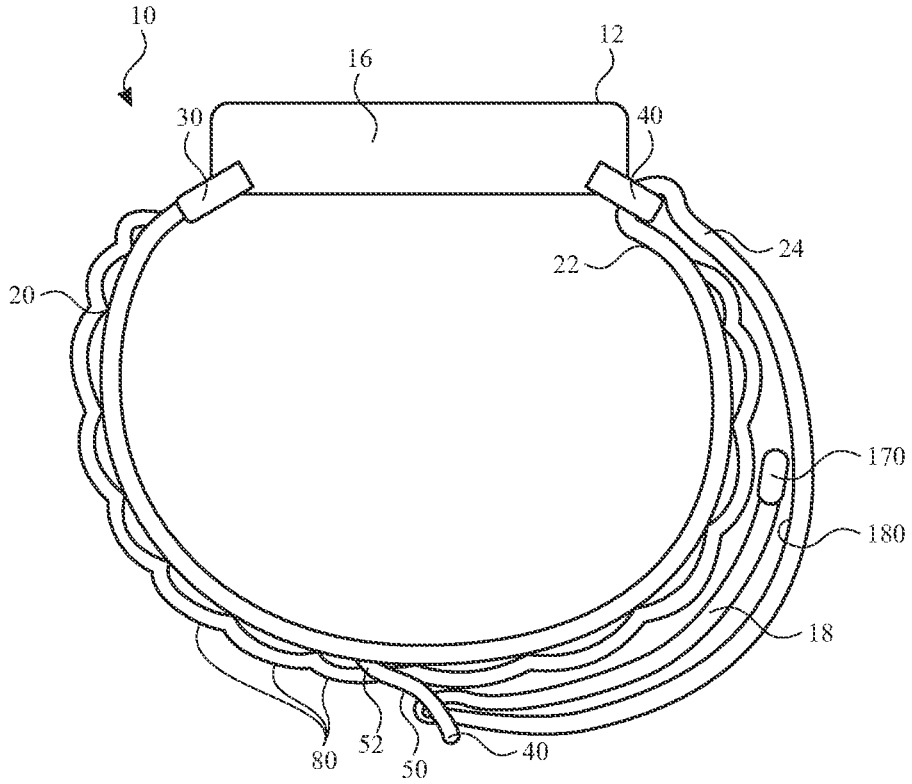
FIG. 40 is a side view of a watch with a watchband in a secured configuration, in accordance with some embodiments of the present disclosure.

Referring now to FIGS. 39 and 40, a watchband can include additional features to provide adjustability of the size of the watchband on a user. It will be understood that such sizing features can be provided in combination with other features described herein, such that multiple sizing mechanisms can optionally be employed on the same watchband.

According to some embodiments, for example as shown in FIG. 39, watchband 20 is adjustable to fit securely and comfortably onto a wrist by selecting an extent of overlap between inner portion 22 and outer portion 24, as described herein with respect to FIGS. 3 and 4. In some embodiments, watchband 20 is also adjustable to fit securely and comfortably onto a wrist by selecting an extent of overlap between inner portion 22 and adjustment portion 18. For example, watchband 20 removably attaches to different portions of housing 16 of watch body 12 with a pair of retaining rings 40. Retaining rings 40 are slidably connected to base 32 of watchband 20 and provides a connection to housing 16 of watch body 12. A first portion of a base 32 of watchband 20 passes through a hole of a first retaining ring 40, such that the length of inner portion 22 and the length of outer portion 24 are defined on either side of first retaining ring 40. A second portion of a base 32 of watchband 20 passes through a hole of a second retaining ring 40, such that the length of inner portion 22 and the length of adjustment portion 18 are defined on either side of second retaining ring 40.

Along inner portion 22, contact surface 26 faces inwardly toward the wrist. Adjustment portion 18 overlaps contact surface 26 of inner portion 22. Along outer portion 24, contact surface 26 continues as an outwardly facing surface. Engagement surface 28 of watchband 20 is positionable to contact itself, as described herein. As shown in FIG. 39, buckle 50 is arranged to engage one of loops 80 on engagement surface 28 and along inner portion 22. Contact surface 26 of watchband 20 is also positionable to contact itself. For example, along adjustment portion 18, contact surface 26 faces outwardly away from the wrist and towards inner portion 22. As further shown in FIG. 39, an engager 170 is arranged to engage one of receptacles 180 on contact surface 26 and along inner portion 22. According to some embodiments, engager 170 and buckle 50 can be located at or near ends of watchband 20.

According to some embodiments, for example as shown in FIG. 39, portions of watchband 20 slidably extends through each of retaining rings 40. The length of watchband 20 that extends between retaining rings 40 can be adjusted as desired by a user for preferred comfort and grip on the wrist of the user.

According to some embodiments, for example as shown in FIG. 40, watchband 20 removably attaches to different portions of housing 16 of watch body 12 with retaining ring 40 and connector 30. A first portion of base 32 of watchband 20 passes through a hole of retaining ring 40, such that the length of inner portion 22 and the length of outer portion 24 are defined on either side of retaining ring 40. A second portion of a base 32 of watchband 20 passes through a hole of buckle 50, such that the length of inner portion 22 and the length of adjustment portion 18 are defined on either side of buckle 50. For example, buckle 50 can form a retaining ring 40 that is not directly connected to a housing or watch body. Buckle 50 forming a retaining ring 40 can be integrally formed with a hook, as described herein.

Along outer portion 24, engagement surface 28 faces inwardly toward the wrist and adjustment portion 18. Adjustment portion 18 overlaps engagement surface 28 of outer portion 24. As shown in FIG. 40, buckle 50 is arranged to engage one of loops 80 on engagement surface 28 and along inner portion 22. Engagement surface 28 of watchband 20 is also positionable to contact itself on either side of buckle 50. For example, along outer portion 24, engagement surface 28 faces inwardly towards the wrist and adjustment portion 18. As further shown in FIG. 40, an engager 170 is arranged to engage one of receptacles 180 on engagement surface 28 and along outer portion 24. Selection of one of receptacles 180 for engagement by engager 170 can determine a length of base 32 between retaining rings 40 (i.e., one retaining ring 40 connected to watch body 16 and another retaining ring 40 formed by buckle 50 and being integrally formed with hook 52). According to some embodiments, engager 170 and connector 30 can be located at or near ends of watchband 20.

According to some embodiments, for example as shown in FIG. 40, portions of watchband 20 slidably extends through each of retaining ring 40 and buckle 50. The length of watchband 20 that extends between retaining ring 40 and connector 30 can be adjusted as desired by a user for preferred comfort and grip on the wrist of the user.

Figure 41:
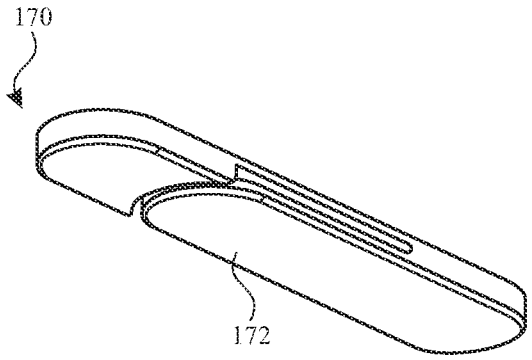
FIG. 41 is a perspective view of an engager of a watchband, in accordance with some embodiments of the present disclosure.
Figure 42:
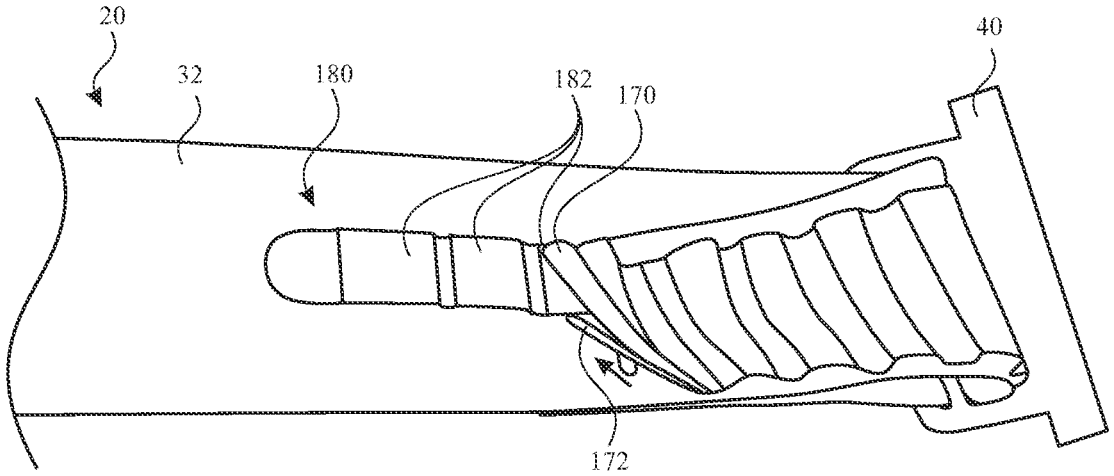
FIG. 42 is a perspective view of a watchband with the engager of FIG. 41 in a free configuration, in accordance with some embodiments of the present disclosure.
Figure 43:
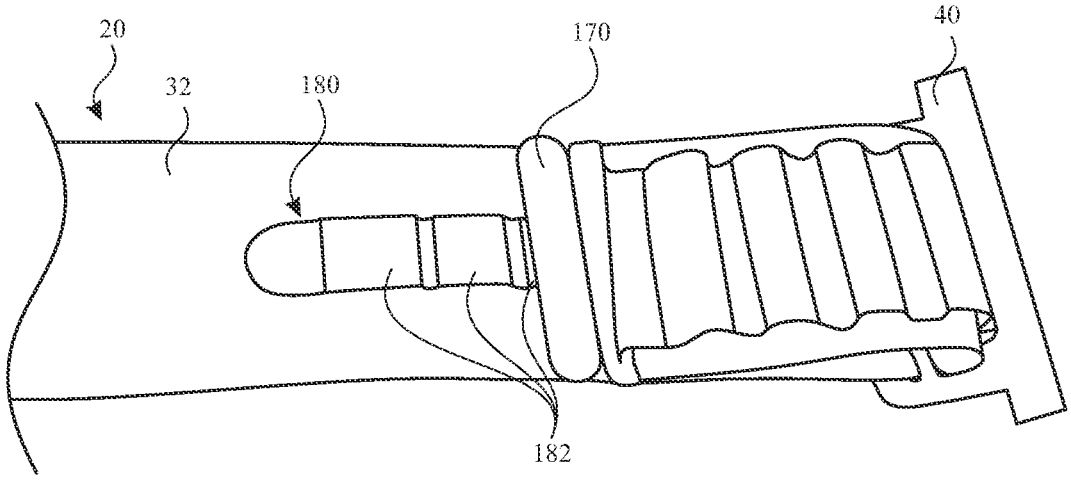
FIG. 43 is a perspective view of the watchband of FIG. 42 in a secured configuration, in accordance with some embodiments of the present disclosure.

Referring now to FIGS. 41-43, an engager formed as an arm can be adjusted to engage one of multiple receptacles formed as loops on a surface of a base. As shown in FIG. 41, engager 170 can be formed as a low-profile structure that includes a flexible arm 172. As shown in FIG. 42, flexible arm 172 can extend laterally across a longitudinal axis of watchband 20 at an end of base 32. For example, flexible arm 172 can be manipulated to extend away from other portions of engager 170 to form a free end for insertion into one of multiple receptacles 180 formed as loops 182. Loops 182 can optionally be formed as described herein with respect to loops of an engagement ribbon. As shown in FIG. 43, as engager 170 extend a distance away from retaining ring 40, a corresponding loop 182 and a proximity thereof can be used to secure engager 170 and to maintain its distance away from retaining ring 40.

Figure 44:
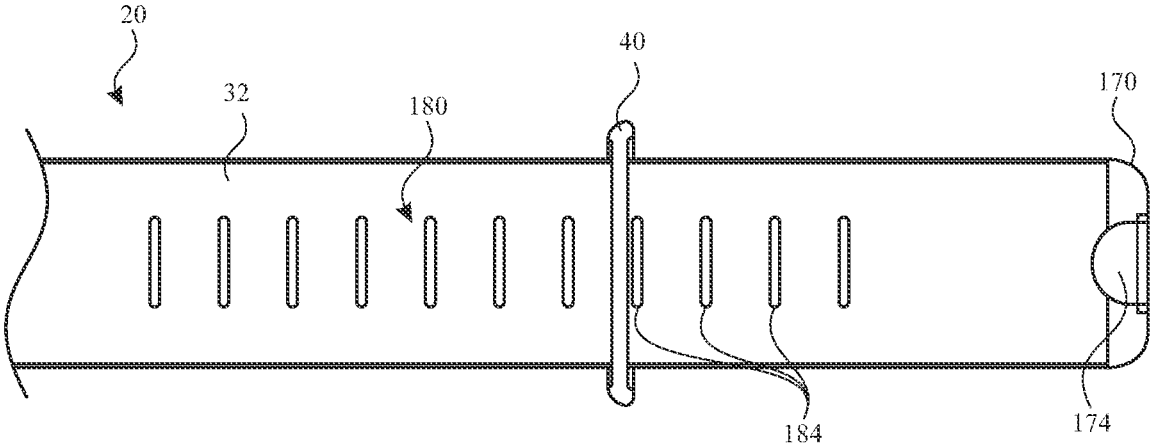
FIG. 44 is a bottom view of a portion of a watchband, in accordance with some embodiments of the present disclosure.

Referring now to FIG. 44, an engager formed as a tab of the watchband can be adjusted to engage one of multiple receptacles formed as notches on a surface of a base. As shown in FIG. 44, engager 170 can be formed as a tab 174 that extends away from an end of base 32. For example, tab 174 can be folded onto base 32 and overlap base 32. Tab 174 can further extend longitudinally away from the end of base 32. Receptacles 180 can be formed as notches 184 that extend into base 32. For example, notches 184 can each form empty spaces that have a complementary shape to receive tab 174. In some embodiments, notches 184 are formed as openings that provide access to separate layers of base 32. As such, tab 174 can be inserted into and engage within one of multiple notches 184. As engager 170 extends a distance away from retaining ring 40, a corresponding notch 184 and a proximity thereof can be used to secure engager 170 and to maintain its distance away from retaining ring 40.

Figure 45:
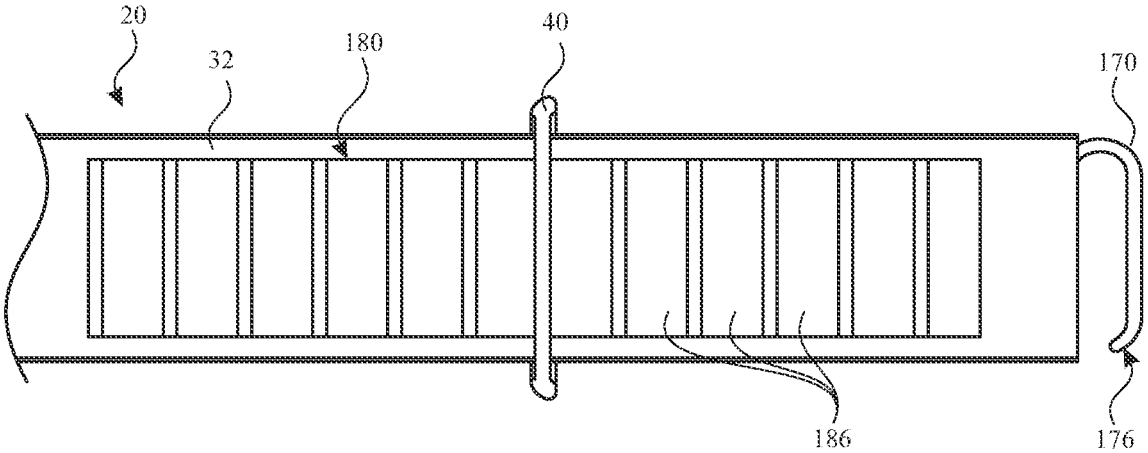
FIG. 45 is a bottom view of a portion of a watchband, in accordance with some embodiments of the present disclosure.

Referring now to FIG. 45, an engager formed as a hook can be adjusted to engage one of multiple receptacles formed as loops on a surface of a base. As shown in FIG. 45, engager 170 can be formed as a rigid hook 176, at least a portion of which extending laterally across a longitudinal axis of watchband 20. Hook 176 can be arranged for insertion into one of multiple receptacles 180 formed as loops 186. Loops 186 can optionally be formed as described herein with respect to loops of an engagement ribbon. As engager 170 extends a distance away from retaining ring 40, a corresponding loop 186 and a proximity thereof can be used to secure engager 170 and to maintain its distance away from retaining ring 40.

Figure 46:
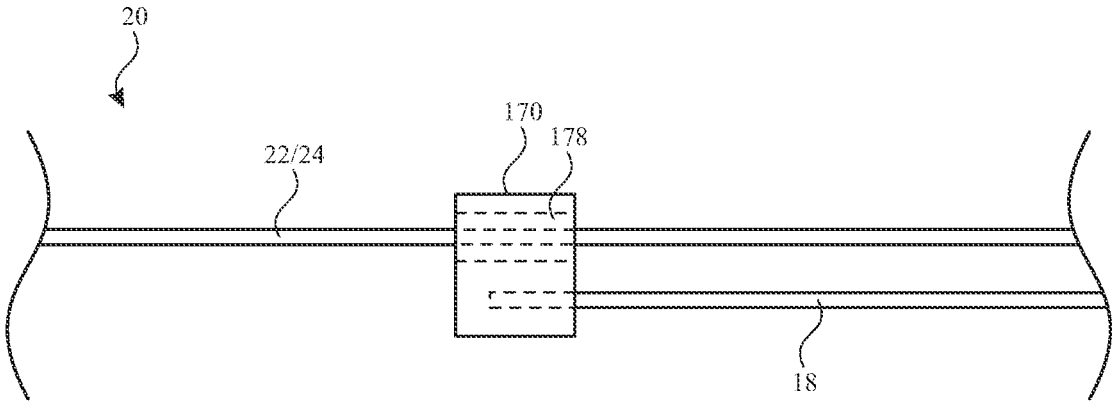
FIG. 46 is a bottom view of a portion of a watchband with a keeper, in accordance with some embodiments of the present disclosure.
Figure 47:
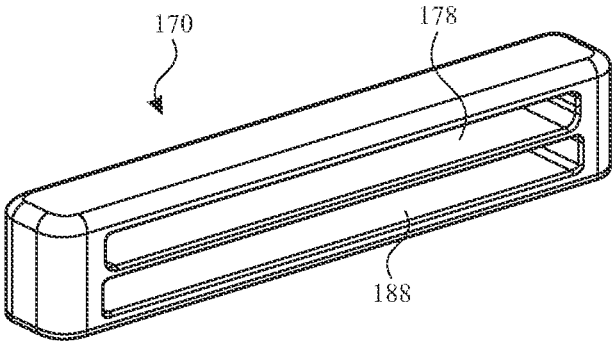
FIG. 47 is a perspective view of a keeper of the watchband of FIG. 46, in accordance with some embodiments of the present disclosure.
Figure 48:
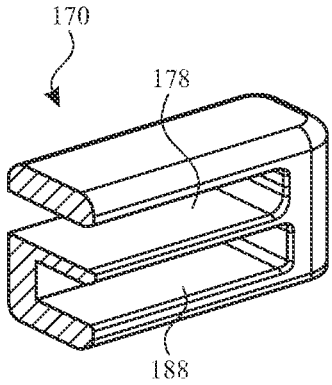
FIG. 48 is a perspective sectional view of the keeper of FIG. 47, in accordance with some embodiments of the present disclosure.

Referring now to FIGS. 46-48, additional structures can be provided to enhance engagement of the watchband. According to some embodiments, for example as shown in FIG. 46, engager 170 can be formed as a capture band that couples to an end of adjustment portion 18 and retains inner portion 22 and/or outer portion 24 when inserted therein. An opening 178 of engager 170 receives inner portion 22 and/or outer portion 24 of watchband 20. In some embodiments, the opening need not form a closed loop, but can only partially extend about inner portion 22 and/or outer portion 24 of watchband 20. In such an arrangement, engager 170 provides additional support to keep adjustment portion 18 engaged and/or aligned with inner portion 22 and/or outer portion 24. Engager 170 can be slidable along a longitudinal length of inner portion 22 and/or outer portion 24. For example, engager 170 can receive an end of adjustment portion 18 within a closed cavity 188, whereas opening 178 can pass entirely through engager 170.

Figure 49:
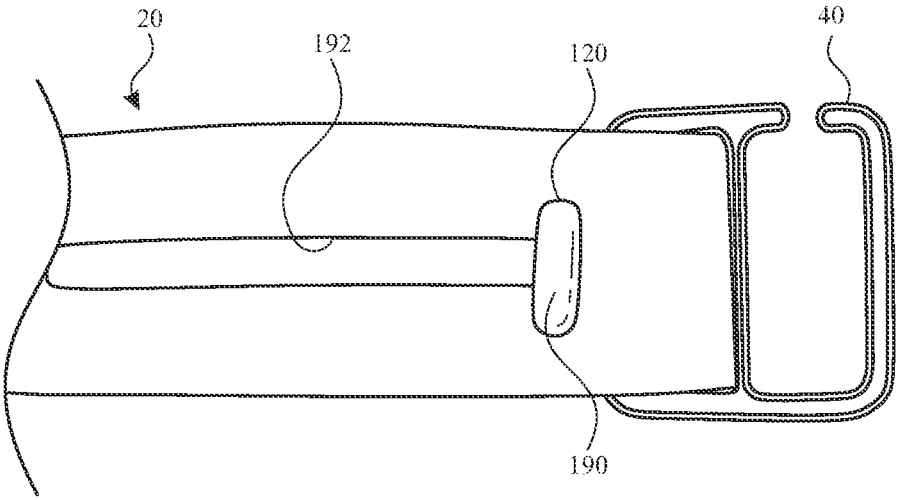
FIG. 49 is a bottom view of a portion of a watchband, in accordance with some embodiments of the present disclosure.
Figure 50:
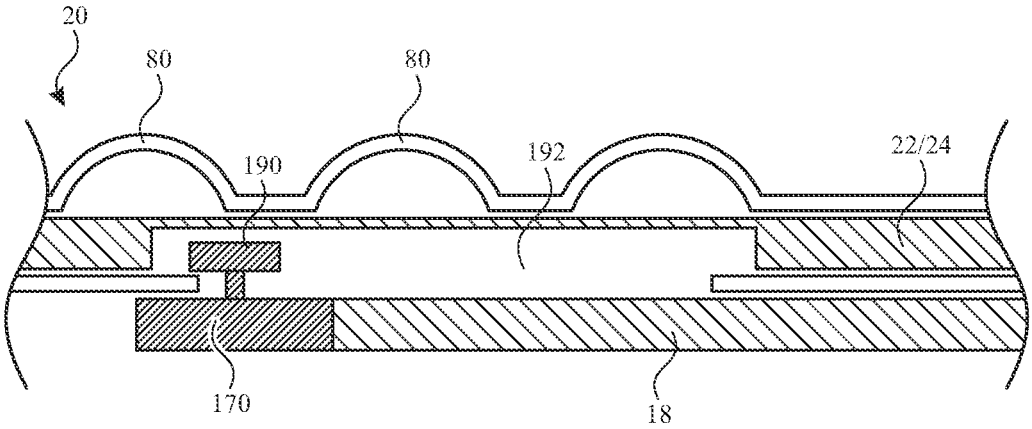
FIG. 50 is a side sectional view of a portion of the watchband of FIG. 49, in accordance with some embodiments of the present disclosure.

Referring now to FIGS. 49-50, yet other structures can be provided to enhance engagement of the watchband. According to some embodiments, for example as shown in FIG. 49, engager 170 can be formed as a protrusion 190 that is slidably coupled to inner portion 22 and/or outer portion 24 when inserted within a track 192. Track 192 can be formed as a part of inner portion 22 and/or outer portion 24. Protrusion 190 can be secured to track 192 while allowing sliding movements longitudinally within track 192. For example, protrusion 190 can have a width that is greater than an opening to track 192. Accordingly, adjustment portion 18 can be positioned longitudinally with respect to inner portion 22 and/or outer portion 24 based on a position of protrusion 190 within track 192.

In some embodiments, yet other structures can be provided to enhance engagement of the watchband. For example, engager 170 and receptacles 180 can include magnets that are attractively coupled to each when brought into proximity. Such a magnetic engager 170 can couple to any one of multiple magnetic receptacles. By further example, engager 170 and/or receptacles 180 can include opposing surfaces that have a significant coefficient of friction. Accordingly, engager 170 can slide with resistance along base 32 so that movement is effected when intentionally provided by the user.

Figure 51:
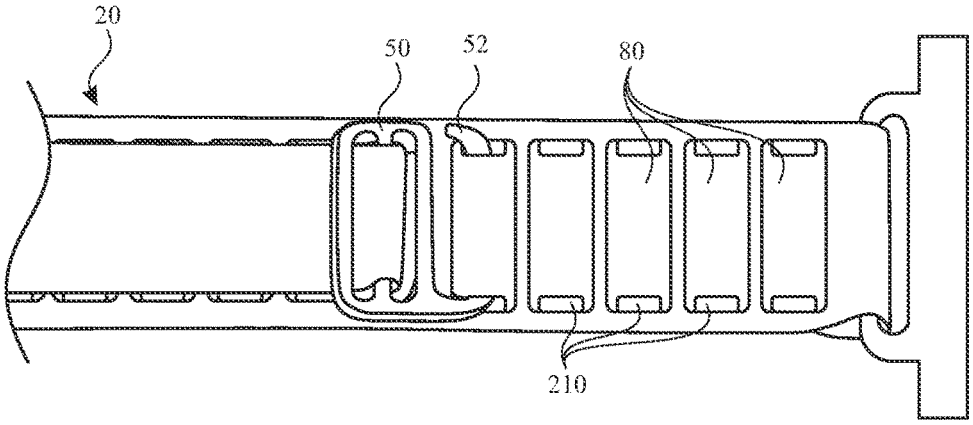
FIG. 51 is a top view of a portion of a watchband, in accordance with some embodiments of the present disclosure.
Figure 52:
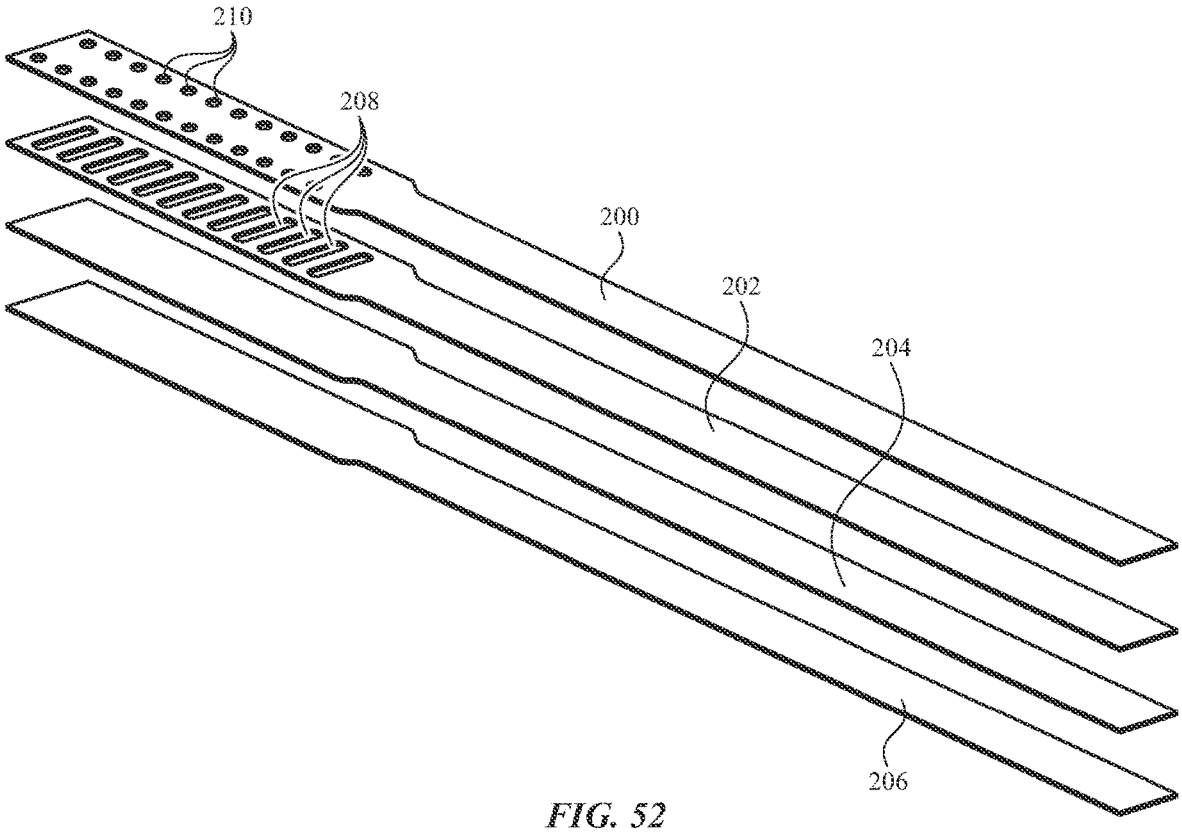
FIG. 52 is an exploded perspective view of the watchband of FIG. 51, in accordance with some embodiments of the present disclosure.

Referring now to FIGS. 51 and 52, one or more of a variety of structures can be provided for engagement by a hook of a buckle. For example, as shown in FIG. 51, watchband 20 can include buckle 50 that forms hook 52. Watchband 20 can further include loops 80 on a surface thereof. Whereas some loops 80 disclosed herein extend from a surface of a base, loops 80 of FIGS. 51 and 52 can lie substantially flat against underlying layers until stretched by insertion of the hook 52 of buckle 50. For example, each loop 80 can be defined by openings 210 that expose an inner layer through an upper cover. Loops 80 can be formed by providing a space between such layers. As such, loops 80 can be formed as integral with the rest of the upper surface of watchband 20, thereby providing a substantially flat surface along and about loops 80.

As shown in FIG. 52, the watchband can be formed from multiple layers. For example, an upper cover 200 and a lower cover 206 can surround inner layers of the watchband. Upper cover 200 and/or lower cover 206 can include flexible, stretchable, elastic, and/or compliant materials, such as fabrics (e.g., knits, weaves, etc.), polymers, leather, and the like. The watchband can further include an upper layer 202 and a lower layer 204. Upper layer 202 and lower layer 204 can include materials that are more resilient than upper cover 200 and/or lower cover 206. Upper layer 202 can include recesses 208 that each align with a corresponding pair of openings 210. Recesses 208 can provide a passageway from one opening 210 to another opening 210. As such, openings 210 and recesses 208 can accommodate reception and engagement of hook 52 of buckle 50.

Figure 53:
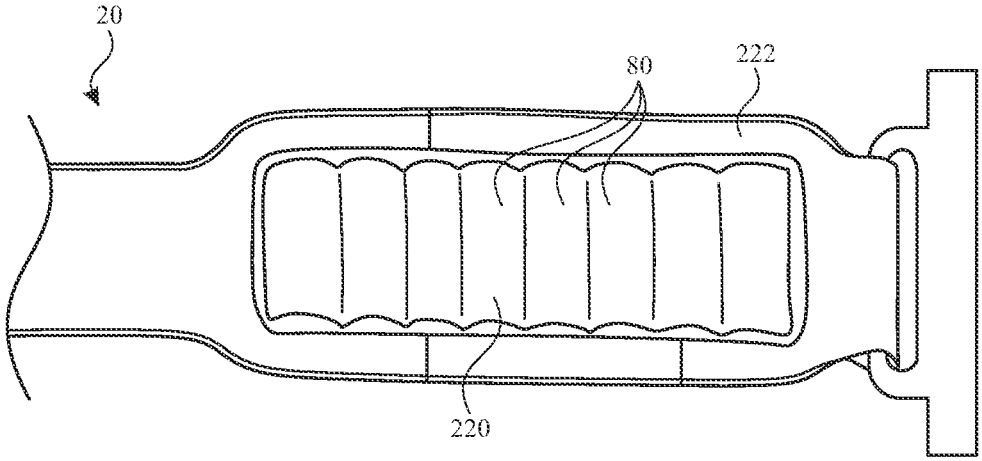
FIG. 53 is a top view of a portion of a watchband, in accordance with some embodiments of the present disclosure.
Figure 54:
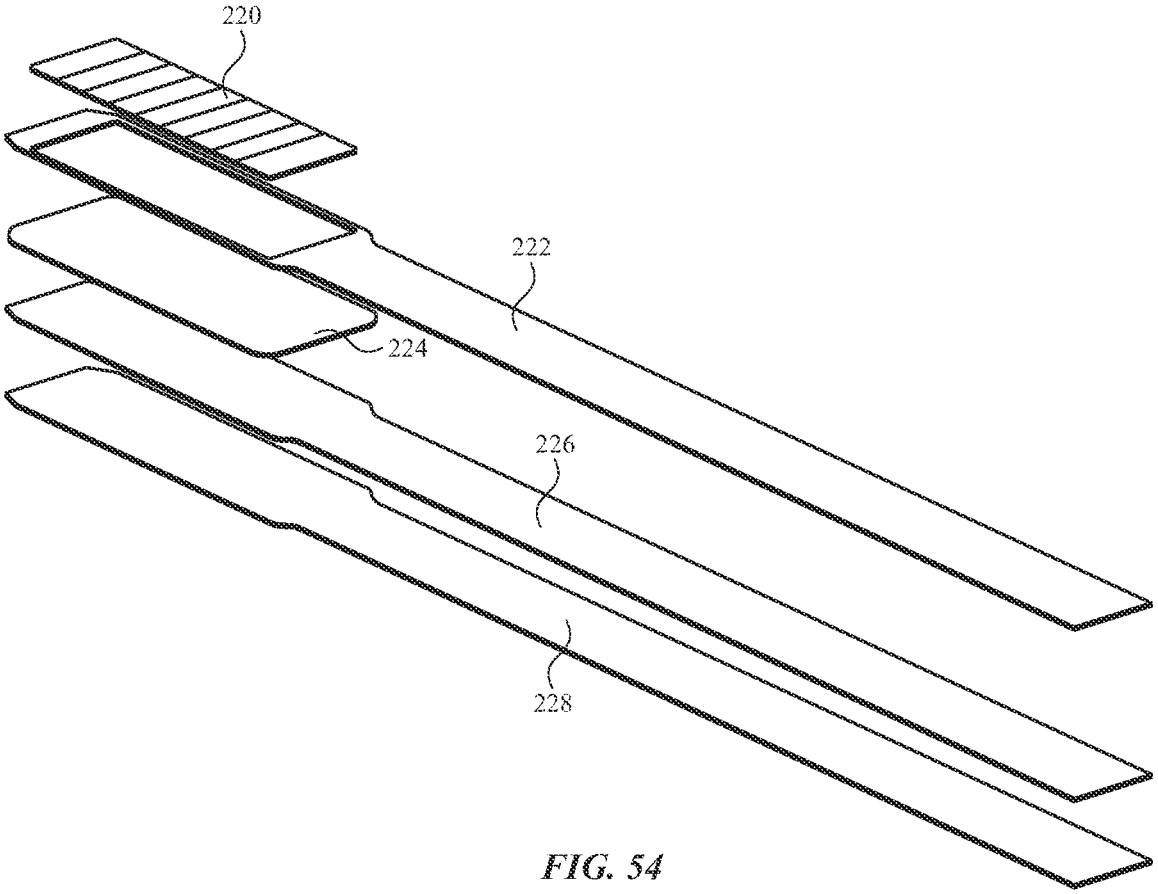
FIG. 54 is an exploded perspective view of the watchband of FIG. 53, in accordance with some embodiments of the present disclosure.
Figure 55:
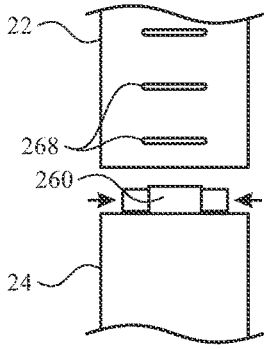
FIG. 55 is a top view of a watchband in a free configuration, in accordance with some embodiments of the present disclosure.

Referring now to FIGS. 53 and 54, one or more of a variety of structures can be provided for engagement by a hook of a buckle. For example, as shown in FIG. 53, watchband 20 can include buckle 50 that forms hook 52. Watchband 20 can further include loops 80 on a surface thereof. For example, each loop 80 can be defined by a loop layer 220 that is coupled to other portions of watchband 20.

As shown in FIG. 54, the watchband can be formed from multiple layers. For example, an upper cover 222 and a lower cover 228 can surround inner layers of the watchband. Upper cover 222 and/or lower cover 228 can include flexible, stretchable, elastic, and/or compliant materials, such as fabrics (e.g., knits, weaves, etc.), polymers, leather, and the like. The watchband can further include an inner layer 226, which can include materials that are more resilient than upper cover 222 and/or lower cover 228. Upper cover 222 can include a recess for receiving loop layer 220. A backing layer 224 can be provided behind upper cover 222, such that loop layer 220 is coupled directly onto backing layer 224, while an outer periphery of backing layer 224 is secure between portions of upper cover 222 and inner layer 226.

Figure 56:
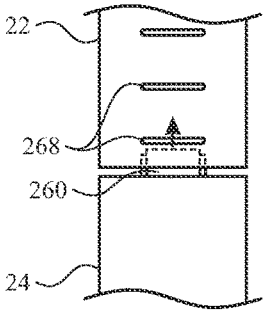
FIG. 56 is a top view of the watchband of FIG. 55, in accordance with some embodiments of the present disclosure.
Figure 57:
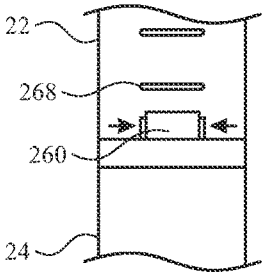
FIG. 57 is a top view of the watchband of FIGS. 55 and 56, in accordance with some embodiments of the present disclosure.
Figure 58:
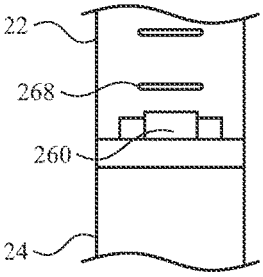
FIG. 58 is a top view of the watchband of FIGS. 55-57 in a secured configuration, in accordance with some embodiments of the present disclosure.

Referring now to FIGS. 55-58, an actuation mechanism can be used to engage inner portion 22 of a watchband to outer portion 24 of the watchband. For example, as shown in FIG. 52, inner portion 22 can define multiple slots 268 extending therethrough. Slots 268 can be distributed longitudinally along a length of inner portion 22. Outer portion 24 can include an engager 260 at an end thereof. Engager 260 can be actuated to change a width thereof. As shown in FIG. 56, engager 260 can be actuated to a retracted configuration having a reduced width. In such a configuration, as shown in FIG. 57, engager 260 can fit within and through one of slots 268. With engager 260 extending from one side of inner portion 22, through a slot 268, and to an opposite side of inner portion 22, engager 260 can be actuated to an extended configuration having an enlarged width, as shown in FIG. 58. In the extended configuration, engager 260 can be too large to fit through slot 268. As such, engager 260 can remain engaged to secure relative positions of inner portion 22 with respect to outer portion 24. It will be understood that mechanisms such as engager 260 and slots 268 can additionally or alternatively be used to engage inner portion 22 and/or outer portion 24 to an adjustment portion of a watchband (as shown in FIGS. 39 and 40).

Figure 59:
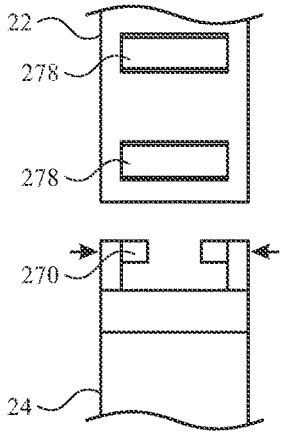
FIG. 59 is a top view of a watchband in a free configuration, in accordance with some embodiments of the present disclosure.
Figure 60:
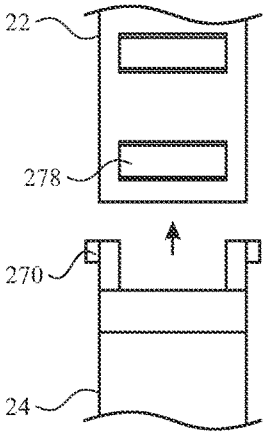
FIG. 60 is a top view of the watchband of FIG. 59, in accordance with some embodiments of the present disclosure.
Figure 61:
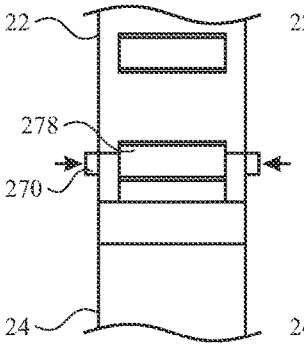
FIG. 61 is a top view of the watchband of FIGS. 59 and 60, in accordance with some embodiments of the present disclosure.
Figure 62:
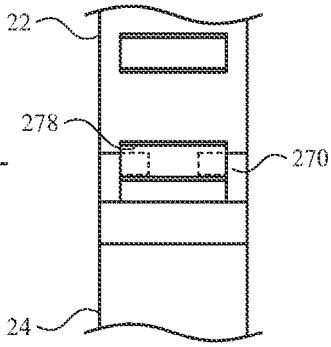
FIG. 62 is a top view of the watchband of FIGS. 59-61 in a secured configuration, in accordance with some embodiments of the present disclosure.

Referring now to FIGS. 59-62, yet another actuation mechanism can be used to engage inner portion 22 of a watchband to outer portion 24 of the watchband. For example, as shown in FIG. 59, inner portion 22 can define multiple loops 278 extending therethrough. Loops 278 can be distributed longitudinally along a length of inner portion 22. Loops 278 can define openings extending laterally across inner portion 22. Outer portion 24 can include an engager 270 at an end thereof. Engager 270 can be actuated to change an inner dimension thereof. As shown in FIG. 60, engager 270 can be actuated to an open configuration having an enlarged inner dimension. In such a configuration, as shown in FIG. 61, engager 270 can be aligned with one of loops 278. With engager 270 aligned a loop 278, engager 270 can be actuated to a closed configuration having a reduced inner dimension, as shown in FIG. 61. In the extended configuration, engager 270 can be of a shape that cannot be readily removed from loop 278. As such, engager 270 can remain engaged to secure relative positions of inner portion 22 with respect to outer portion 24. It will be understood that mechanisms such as engager 270 and loops 278 can additionally or alternatively be used to engage inner portion 22 and/or outer portion 24 to an adjustment portion of a watchband (as shown in FIGS. 39 and 40).

Figure 63:
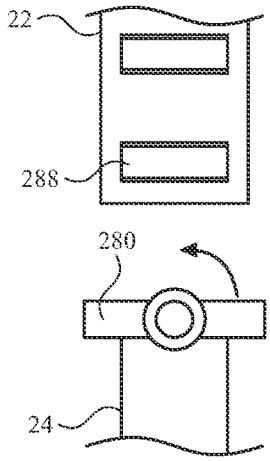
FIG. 63 is a top view of a watchband in a free configuration, in accordance with some embodiments of the present disclosure.
Figure 64:
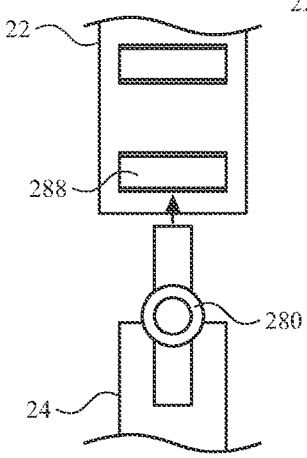
FIG. 64 is a top view of the watchband of FIG. 63, in accordance with some embodiments of the present disclosure.
Figure 65:
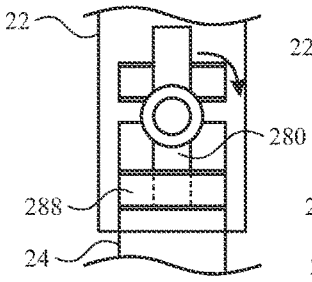
FIG. 65 is a top view of the watchband of FIGS. 63 and 64, in accordance with some embodiments of the present disclosure.
Figure 66:
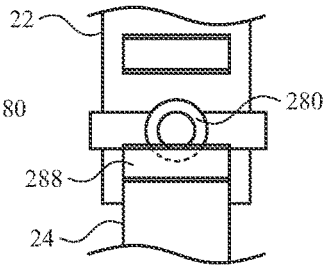
FIG. 66 is a top view of the watchband of FIGS. 63-65 in a secured configuration, in accordance with some embodiments of the present disclosure.

Referring now to FIGS. 63-66, a rotating mechanism can be used to engage inner portion 22 of a watchband to outer portion 24 of the watchband. For example, as shown in FIG. 63, inner portion 22 can define multiple loops 288 extending therethrough. Loops 288 can be distributed longitudinally along a length of inner portion 22. Loops 278 can define openings extending longitudinally along inner portion 22. Outer portion 24 can include an engager 280 at an end thereof. Engager 280 can be actuated to change an orientation thereof. As shown in FIG. 64, engager 280 can be actuated to a first orientation having a reduced width. In such an orientation, as shown in FIG. 65, engager 280 can fit within and through one of loops 288. With engager 280 extending through a loop 288, engager 280 can be actuated to a second orientation having an enlarged width, as shown in FIG. 66. In the extended orientation, engager 280 can be too large to fit through loop 288. As such, engager 280 can remain engaged to secure relative positions of inner portion 22 with respect to outer portion 24. It will be understood that mechanisms such as engager 280 and loops 288 can additionally or alternatively be used to engage inner portion 22 and/or outer portion 24 to an adjustment portion of a watchband (as shown in FIGS. 39 and 40).

Figure 67:
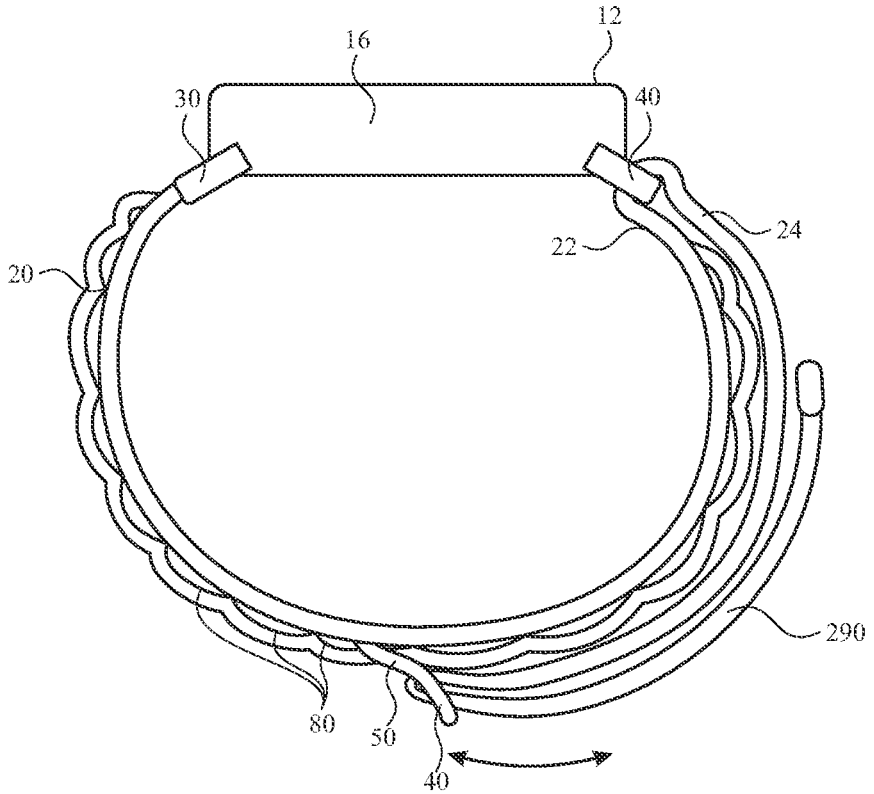
FIG. 67 is a side view of a watch with a watchband in a secured configuration, in accordance with some embodiments of the present disclosure.

Referring now to FIG. 67, a watchband can include additional features to provide adjustability of the size of the watchband on a user. It will be understood that such sizing features can be provided in combination with other features described herein, such that multiple sizing mechanisms can optionally be employed on the same watchband. According to some embodiments, for example as shown in FIG. 67, watchband 20 removably attaches to different portions of housing 16 of watch body 12 with retaining ring 40 and connector 30. A first portion of base 32 of watchband 20 passes through a hole of retaining ring 40, such that the length of inner portion 22 and the length of outer portion 24 are defined on either side of retaining ring 40. A second portion of a base 32 of watchband 20 passes through a hole of buckle 50, such that the length of inner portion 22 and the length of adjustment portion 290 are defined on either side of buckle 50. For example, buckle 50 can form a retaining ring 40 that is not directly connected to a housing or watch body. Buckle 50 forming a retaining ring 40 can be integrally formed with a hook, as described herein. Adjustment portion 290 overlaps engagement surface 28 of outer portion 24. As shown in FIG. 67, buckle 50 is arranged to engage one of loops 80 on engagement surface 28 and along inner portion 22. As further shown in FIG. 67, adjustment portion 290 forms a free end that is on an outer side of outer portion 24. As such, the chosen length of adjustment portion 290 (e.g., one side of buckle 50) can affect the remaining length available between retaining ring 40 and buckle 50. According to some embodiments, for example as shown in FIG. 67, portions of watchband 20 slidably extends through each of retaining ring 40 and buckle 50. The length of watchband 20 that extends between retaining ring 40 and connector 30 can be adjusted as desired by a user for preferred comfort and grip on the wrist of the user.

Accordingly, embodiments of the present disclosure provide a watchband that can comfortably secure an electronic device to a wrist of a user. The watchband can include a base having a contact surface opposite an engagement surface and an engagement ribbon forming loops on the engagement surface of the base for receiving a hook of a buckle. The engagement ribbon can be interwoven with the base to provide secure anchoring for the hook within one of the loops. The woven portions of the watchband can be securely coupled to end structures, such as the buckle, retaining rings, and/or a connector. The watchband provides adjustable lengths to accommodate different fit configurations as desired.

Various examples of aspects of the disclosure are described below as clauses for convenience. These are provided as examples, and do not limit the subject technology.

Clause A: a watchband comprising: a base defining a contact surface opposite an engagement surface; an engagement ribbon; a coupling thread interwoven with the base and multiple coupling regions of the engagement ribbon, wherein the engagement ribbon forms multiple loops, each of the loops extending away from the engagement surface of the base between a corresponding pair of the coupling regions; and a hook disposed at an end of the base and configured to engage one of the loops of the engagement ribbon.

Clause B: a watchband comprising: a base formed by interwoven base threads; an engagement ribbon formed by interwoven ribbon threads and defining coupling regions coupled to the base and loops extending away from the base; a coupling thread comprising: coupling portions interwoven with the base and the coupling regions of the engagement ribbon; and hidden portions across from the loops of the engagement ribbon, the hidden portions extending entirely within the base; and a hook disposed at an end of the base and configured to engage one of the loops of the engagement ribbon.

Clause C: a watchband comprising: a base formed by interwoven base threads, at least some of the base threads being elastic threads that extend longitudinally within the base to allow the base to stretch longitudinally; an engagement ribbon formed by interwoven inelastic threads; a coupling thread interwoven with the base and the engagement ribbon, wherein the engagement ribbon forms loops that extend away from the base; and a hook disposed at an end of the base and configured to engage one of the loops of the engagement ribbon.

Clause D: a watchband comprising: a base defining a contact surface opposite an engagement surface; an engagement ribbon forming multiple loops extending away from the engagement surface of the base; and a hook disposed at an end of the base and configured to engage one of the loops of the engagement ribbon, wherein the engagement ribbon extends from the engagement surface of the base, about a bar coupled to the hook, and to the contact surface of the base.

Clause E: a watchband comprising: a connector configured to connect to a side of a watch body; a base defining a contact surface opposite an engagement surface, the base being coupled to an end portion and having an opening, the end portion extending about a portion of the connector, through the opening, and to the contact surface of the base; and an engagement ribbon forming multiple loops extending away from the engagement surface of the base, the engagement ribbon extending from the engagement surface of the base, about the end portion, and to the contact surface of the base.

Clause F: a watchband comprising: a base defining a contact surface opposite an engagement surface; an engagement ribbon forming multiple loops extending away from the engagement surface of the base; a hook disposed coupled to the base and configured to engage one of the loops of the engagement ribbon; a first retaining ring slidably retaining the base within a first hole of the first retaining ring such that, as the base overlaps itself alongside the first retaining ring, the hook is disposed at the engagement surface of the base; receptacles formed on the contact surface of the base; an engager disposed at an end of the base and configured to engage one of the receptacles; and a second retaining ring slidably retaining the base within a second hole of the second retaining ring such that, as the base overlaps itself alongside the second retaining ring, the engager is disposed at the contact surface of the base.

One or more of the above clauses can include one or more of the features described below. It is noted that any of the following clauses may be combined in any combination with each other, and placed into a respective independent clause, e.g., clause A, B, or C.

Clause 1: the base is formed from continuously woven base threads, and the engagement ribbon is formed from continuously woven ribbon threads.

Clause 2: the engagement ribbon extends about an additional end of the base, is coupled to the contact surface of the base, and forms additional loops extending away from the contact surface of the base.

Clause 3: the base is wider than the engagement ribbon.

Clause 4: the coupling thread extends continuously through each of the multiple coupling regions.

Clause 5: the coupling thread comprises: coupling portions interwoven with the base and the coupling regions of the engagement ribbon; and hidden portions across from the loops of the engagement ribbon, the hidden portions extending entirely within the base.

Clause 6: the base is formed by interwoven base threads, at least some of the base threads being elastic threads that extend longitudinally within the base to allow the base to stretch longitudinally, and the engagement ribbon is formed by interwoven inelastic threads.

Clause 7: a retaining ring slidably retaining the base within a hole of the retaining ring.

Clause 8: the retaining ring is configured to connect to a first side of a watch body, the watchband further comprising a connector affixed to another end of the base and configured to connect to a second side of the watch body.

Clause 9: at each of the coupling regions, the coupling thread makes multiple turns about the base threads and the ribbon threads, and between each adjacent pair of the coupling regions, the coupling thread makes multiple turns about the base threads.

Clause 10: at least some of the base threads are elastic threads that extend longitudinally within the base to allow the base to stretch longitudinally, and the ribbon threads are inelastic threads.

Clause 11: the base is wider than the engagement ribbon.

Clause 12: the coupling thread extends continuously through each of the coupling regions.

Clause 13: a reinforcement strip extending from a first location between the engagement ribbon and the engagement surface of the base, about the bar, and to a second location between the engagement ribbon and the contact surface of the base.

Clause 14: a stitch coupling the reinforcement strip to the engagement surface of the base and the contact surface of the base, wherein the engagement ribbon covers the stitch.

Clause 15: an adhesive coupling the engagement ribbon to the contact surface of the base.

Clause 16: the bar is rotatably coupled to a main body forming the hook.

Clause 17: the base is formed from continuously woven base threads, and the engagement ribbon is formed from continuously woven ribbon threads.

Clause 18: a portion of the base overlaps itself, the watchband further comprising an adhesive coupling the portion of the base to itself.

Clause 19: a stitch coupling the end portion to the contact surface of the base, wherein the engagement ribbon covers the stitch.

Clause 20: a reinforcement strip extending from a first location between the engagement ribbon and the engagement surface of the base, about the end portion, and to a second location between the engagement ribbon and the contact surface of the base.

Clause 21: the end portion is narrower than a portion of the base forming the opening.

Clause 22: the base is formed from continuously woven base threads, and the engagement ribbon is formed from continuously woven ribbon threads.

Clause 23: the receptacles comprise additional loops distributed along a length of the contact surface, and the engager comprises a flexible arm extending laterally across the end of the base.

Clause 24: the receptacles comprise notches distributed along a length of the contact surface, and the engager comprises a tab extending away from the end of the base.

Clause 25: the receptacles comprise additional loops formed by an additional ribbon coupled to the base, the additional loops being distributed along a length of the contact surface, and the engager comprises an additional hook.

Clause 26: the first retaining ring is configured to connect to a first side of a watch body, the second retaining ring is configured to connect to a second side of the watch body, and the hook is disposed at another end of the base.

Clause 27: a connector at another end of the base and configured to connect to a first side of a watch body, wherein the first retaining ring is configured to connect to a second side of the watch body, and wherein the second retaining ring is integrally formed with the hook.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A watchband comprising:

a base defining a contact surface opposite an engagement surface;

an engagement ribbon forming multiple loops extending away from the engagement surface of the base;

a hook disposed at an end of the base and configured to engage one of the loops of the engagement ribbon, wherein the engagement ribbon extends from the engagement surface of the base, about a bar coupled to the hook, and to the contact surface of the base;

a reinforcement strip extending from a first location between the engagement ribbon and the engagement surface of the base, about the bar, and to a second location between the engagement ribbon and the contact surface of the base; and a stitch coupling the reinforcement strip to the engagement surface of the base and the contact surface of the base, wherein the engagement ribbon covers the stitch.

2. The watchband of claim 1, further comprising an adhesive coupling the engagement ribbon to the contact surface of the base.

3. The watchband of claim 1, wherein the bar is rotatably coupled to a main body forming the hook.

4. The watchband of claim 1, wherein:

the base is formed from continuously woven base threads, and the engagement ribbon is formed from continuously woven ribbon threads.

5. A watchband comprising:

a connector configured to connect to a side of a watch body;

a base defining a contact surface opposite an engagement surface, the base being coupled to an end portion and having an opening, the end portion extending about a portion of the connector, through the opening, and to the contact surface of the base; and an engagement ribbon forming multiple loops extending away from the engagement surface of the base, the engagement ribbon extending from the engagement surface of the base, about the end portion, and to the contact surface of the base.

6. The watchband of claim 5, wherein a portion of the base overlaps itself, the watchband further comprising an adhesive coupling the portion of the base to itself.

7. The watchband of claim 5, further comprising a stitch coupling the end portion to the contact surface of the base, wherein the engagement ribbon covers the stitch.

8. The watchband of claim 5, further comprising a reinforcement strip extending from a first location between the engagement ribbon and the engagement surface of the base, about the end portion, and to a second location between the engagement ribbon and the contact surface of the base.

9. The watchband of claim 8, further comprising a stitch coupling the reinforcement strip to the engagement surface of the base and the contact surface of the base, wherein the engagement ribbon covers the stitch.

10. The watchband of claim 8, further comprising an adhesive coupling the engagement ribbon to the contact surface of the base.

11. The watchband of claim 5, wherein the end portion is narrower than a portion of the base forming the opening.

12. The watchband of claim 5, wherein:

the base is formed from continuously woven base threads, and the engagement ribbon is formed from continuously woven ribbon threads.

13. A watchband comprising:

a base defining a contact surface opposite an engagement surface;

an engagement ribbon forming multiple loops extending away from the engagement surface of the base;

a hook disposed coupled to the base and configured to engage one of the loops of the engagement ribbon;

a first retaining ring slidably retaining the base within a first hole of the first retaining ring such that, as the base overlaps itself alongside the first retaining ring, the hook is disposed at the engagement surface of the base;

receptacles formed on the contact surface of the base;

an engager disposed at an end of the base and configured to engage one of the receptacles; and a second retaining ring slidably retaining the base within a second hole of the second retaining ring such that, as the base overlaps itself alongside the second retaining ring, the engager is disposed at the contact surface of the base.

14. The watchband of claim 13, wherein:

the receptacles comprise additional loops distributed along a length of the contact surface, and the engager comprises a flexible arm extending laterally across the end of the base.

15. The watchband of claim 13, wherein:

the receptacles comprise notches distributed along a length of the contact surface, and the engager comprises a tab extending away from the end of the base.

16. The watchband of claim 13, wherein:

the receptacles comprise additional loops formed by an additional ribbon coupled to the base, the additional loops being distributed along a length of the contact surface, and the engager comprises an additional hook arm.

17. The watchband of claim 13, wherein:

the first retaining ring is configured to connect to a first side of a watch body, the second retaining ring is configured to connect to a second side of the watch body, and the hook is disposed at another end of the base.

18. The watchband of claim 13, further comprising:

a connector at another end of the base and configured to connect to a first side of a watch body, wherein the first retaining ring is configured to connect to a second side of the watch body, and wherein the second retaining ring is integrally formed with the hook.

19. The watchband of claim 1, further comprising:

a connector configured to connect to a side of a watch body; and the base being coupled to an end portion and having an opening, the end portion extending about a portion of the connector, through the opening, and to the contact surface of the base.

20. The watchband of claim 5, further comprising a hook disposed at an end of the base and configured to engage one of the loops of the engagement ribbon, wherein the engagement ribbon extends from the engagement surface of the base, about a bar coupled to the hook, and to the contact surface of the base.

* * * * *